US006897193B2

(12) United States Patent
Kischkel et al.

(10) Patent No.: US 6,897,193 B2
(45) Date of Patent: May 24, 2005

(54) HYDROXY MIXED ETHERS AND POLYMERS IN THE FORM OF SOLID PREPARATIONS AS A STARTING COMPOUND FOR LAUNDRY DETERGENTS, DISHWASHING DETERGENTS AND CLEANING COMPOSITIONS

(75) Inventors: Ditmar Kischkel, Monheim (DE); Manfred Weuthen, Langenfeld (DE); Michael Elsner, Heiligenhaus (DE)

(73) Assignee: Cognis Deutschland GmbH & Co., KG, Duesseldorf (DE)

( * ) Notice: Subject to any disclaimer, the term of this patent is extended or adjusted under 35 U.S.C. 154(b) by 55 days.

(21) Appl. No.: 10/320,987

(22) Filed: Dec. 17, 2002

(65) Prior Publication Data

US 2003/0171243 A1 Sep. 11, 2003

(30) Foreign Application Priority Data

Dec. 22, 2001 (DE) ..... 101 63 856

(51) Int. Cl.[7] ..... C11D 1/38; C11D 3/37; C11D 11/00

(52) U.S. Cl. ..... 510/475; 510/238; 510/239; 510/240; 510/356; 510/360; 510/421; 510/422; 510/426; 510/446; 510/470; 510/499; 510/504; 510/505; 510/506

(58) Field of Search ..... 510/238, 239, 510/240, 356, 360, 421, 422, 426, 446, 470, 475, 499, 504, 505, 506

(56) References Cited

U.S. PATENT DOCUMENTS

| | | | | |
|---|---|---|---|---|
| 3,966,629 | A | 6/1976 | Dumbrell | |
| 4,062,647 | A | 12/1977 | Storm et al. | |
| 4,172,887 | A | 10/1979 | Vanlerberghe et al. | |
| 4,524,009 | A | 6/1985 | Valenty | |
| 4,639,325 | A | 1/1987 | Valenty et al. | |
| 4,664,839 | A | 5/1987 | Rieck | |
| 4,737,306 | A | 4/1988 | Wichelhaus et al. | |
| 4,816,553 | A | 3/1989 | Baur et al. | |
| 4,985,553 | A | 1/1991 | Fuertes et al. | |
| 5,002,695 | A | 3/1991 | Schulz et al. | |
| 5,318,733 | A | 6/1994 | Carduck et al. | |
| 5,356,607 | A | 10/1994 | Just | |
| 5,374,716 | A | 12/1994 | Biermann et al. | |
| 5,431,780 | A | 7/1995 | Raehse et al. | |
| 5,494,488 | A | 2/1996 | Arnoldi et al. | |
| 5,501,814 | A | 3/1996 | Engelskirchen et al. | |
| 5,536,430 | A | 7/1996 | Fues et al. | |
| 5,541,316 | A | 7/1996 | Engelskirchen et al. | |
| 5,576,425 | A | 11/1996 | Hill et al. | |
| 5,580,941 | A | 12/1996 | Krause et al. | |
| 5,637,560 | A | 6/1997 | Raehse et al. | |
| 5,780,420 | A | 7/1998 | Breuer et al. | |
| 5,821,360 | A | 10/1998 | Engelskirchen et al. | |
| 5,830,956 | A | 11/1998 | Stockhausen et al. | |
| 5,959,101 | A | 9/1999 | Engelskirchen et al. | |
| 6,075,001 | A | 6/2000 | Wilde | |
| 6,153,576 | A | 11/2000 | Blum et al. | |
| 6,187,055 | B1 | 2/2001 | Kottwitz et al. | |
| 6,200,946 | B1 | 3/2001 | Blum et al. | |
| 6,506,720 | B1 | 1/2003 | Blasey et al. | |
| 6,530,383 | B1 * | 3/2003 | Rogmann et al. | 134/25.2 |
| 2003/0153481 | A1 * | 8/2003 | Kischkel et al. | 510/421 |
| 2003/0171243 | A1 * | 9/2003 | Kischkel et al. | 510/421 |

FOREIGN PATENT DOCUMENTS

| | | | | |
|---|---|---|---|---|
| DE | 2 334 899 | A | 1/1974 | |
| DE | 2432757 | * | 1/1976 | C07C/43/11 |
| DE | 25 53 900 | A1 | 6/1977 | |
| DE | 35 26 405 | A1 | 2/1987 | |
| DE | 38 16 842 | A1 | 11/1989 | |
| DE | 40 30 688 | A1 | 4/1992 | |
| DE | 42 04 035 | A1 | 8/1993 | |
| DE | 42 04 090 | A1 | 8/1993 | |
| DE | 42 06 050 | A1 | 9/1993 | |
| DE | 42 06 495 | A1 | 9/1993 | |
| DE | 42 06 521 | A1 | 9/1993 | |
| DE | 42 08 773 | A1 | 9/1993 | |
| DE | 42 09 432 | A1 | 9/1993 | |
| DE | 42 21 381 | C1 | 2/1994 | |
| DE | 42 34 376 | A1 | 4/1994 | |
| DE | 43 00 772 | A1 | 7/1994 | |
| DE | 43 03 320 | A1 | 8/1994 | |

(Continued)

OTHER PUBLICATIONS

R. Lochhead et al., "Encyclopedia of Polymers and Thickeners for Cosmetics", Cosmetics & Toiletries, vol. 108, (May, 1993), pp. 95–114, 116–124, 127–130, 132–135.

(Continued)

*Primary Examiner*—Brian P. Mruk
(74) *Attorney, Agent, or Firm*—Aaron R. Ettelman; Daniel S. Ortiz

(57) ABSTRACT

Solid composition useful for the production of dishwashing, laundry or cleaning compositions are comprised of (a) a hydroxy mixed ether of the formula (I)

$$R^1\overset{OH}{\overset{|}{C}}H-CHR^2O(CH_2CH_2O)_{n1}(CH_2\overset{CH_3}{\overset{|}{C}}HO)_m(CH_2CH_2O)_{n2}R^3 \quad (I)$$

wherein $R^1$ is a linear or branched alkyl group having from 2 to 18 carbon atoms, $R^2$ is hydrogen or a linear or branched alkyl group having from 2 to 18 carbon atoms, $R^3$ is a linear or branched alkyl and/or alkenyl group having from 1 to 22 carbon atoms, each of n1 and n2 independently is a number from 0 to 60 and m is 0 or a number from 0.5 to 5, with the provisos that the total number of carbon atoms in the substituents $R^1$ and $R^2$ is at least 6 and the sum (n1+m+n2) is greater than 0; and (b) a polymer. The compositions according to the invention can optionally contain additional nonionic surfactants, carriers, auxiliaries and additives typically found in laundry detergents, dishwashing detergents and cleaning compositions.

17 Claims, No Drawings

FOREIGN PATENT DOCUMENTS

| | | | | | |
|---|---|---|---|---|---|
| DE | 44 00 024 | A1 | | 7/1995 | |
| DE | 44 16 438 | A1 | | 11/1995 | |
| DE | 44 17 734 | A1 | | 11/1995 | |
| DE | 44 43 177 | A1 | | 6/1996 | |
| DE | 195 24 287 | A1 | | 1/1997 | |
| DE | 195 29 905 | A1 | | 2/1997 | |
| DE | 195 36 082 | A1 | | 4/1997 | |
| DE | 195 47 457 | A1 | | 6/1997 | |
| DE | 196 00 018 | A1 | | 7/1997 | |
| DE | 196 05 688 | A1 | | 8/1997 | |
| DE | 196 13 103 | A1 | | 10/1997 | |
| DE | 196 20 411 | A1 | | 10/1997 | |
| DE | 196 16 693 | A1 | | 11/1997 | |
| DE | 196 16 767 | A1 | | 11/1997 | |
| DE | 196 16 769 | A1 | | 11/1997 | |
| DE | 196 16 770 | A1 | | 11/1997 | |
| DE | 196 20 267 | A1 | | 11/1997 | |
| DE | 197 09 991 | C2 | | 9/1998 | |
| DE | 197 10 254 | A1 | | 9/1998 | |
| DE | 197 38 866 | A1 | | 3/1999 | |
| DE | 19738866 | | * | 3/1999 | ..... C11D/1/825 |
| EP | 0 026 529 | B2 | | 4/1981 | |
| EP | 0 028 432 | B1 | | 5/1981 | |
| EP | 0 150 930 | B1 | | 8/1985 | |
| EP | 0 164 514 | A1 | | 12/1985 | |
| EP | 0 232 202 | B1 | | 8/1987 | |
| EP | 0 272 030 | A2 | | 6/1988 | |
| EP | 0 280 223 | B1 | | 8/1988 | |
| EP | 0 301 298 | B1 | | 2/1989 | |
| EP | 0 309 931 | B1 | | 4/1989 | |
| EP | 0 392 592 | B1 | | 10/1990 | |
| EP | 0 427 349 | B1 | | 5/1991 | |
| EP | 0 443 651 | B1 | | 8/1991 | |
| EP | 0 446 982 | B1 | | 9/1991 | |
| EP | 0 453 003 | B1 | | 10/1991 | |
| EP | 0 458 397 | B1 | | 11/1991 | |
| EP | 0 458 398 | B1 | | 11/1991 | |
| EP | 0 472 042 | A1 | | 2/1992 | |
| EP | 0 486 592 | B1 | | 5/1992 | |
| EP | 0 496 510 | B1 | | 7/1992 | |
| EP | 0 525 239 | B1 | | 2/1993 | |
| EP | 0 542 496 | B1 | | 5/1993 | |
| EP | 0 544 490 | A1 | | 6/1993 | |
| EP | 0 544 519 | B1 | | 6/1993 | |
| EP | 0 549 271 | B1 | | 6/1993 | |
| EP | 0 549 272 | A1 | | 6/1993 | |
| EP | 0 693 049 | B1 | | 1/1996 | |
| EP | 0 693 550 | A2 | | 1/1996 | |
| EP | 0 703 292 | B1 | | 3/1996 | |
| EP | WO 00/46327 | | * | 8/2000 | ..... C11D/1/825 |
| EP | WO 01/55285 | | * | 8/2001 | ..... C11D/1/825 |
| EP | WO 01/55288 | | * | 8/2001 | ..... C11D/1/825 |
| EP | WO 01/55289 | | * | 8/2001 | ..... C11D/1/825 |
| FR | 2 252 840 | A | | 8/1975 | |
| GB | 1 400 898 | A | | 7/1975 | |
| GB | 94 19 091 | A1 | | 9/1994 | |
| JP | 93/339896 | A | | 12/1993 | |
| WO | WO 90/03977 | A1 | | 4/1990 | |
| WO | WO 91/08171 | A1 | | 6/1991 | |
| WO | WO 92/18542 | A1 | | 10/1992 | |
| WO | WO 93/02176 | A1 | | 2/1993 | |
| WO | WO 93/08251 | A1 | | 4/1993 | |
| WO | WO 93/16110 | A1 | | 8/1993 | |
| WO | WO 94/09111 | A1 | | 4/1994 | |
| WO | WO 94/22800 | A1 | | 10/1994 | |
| WO | WO 94/27970 | A1 | | 12/1994 | |
| WO | WO 94/28030 | A1 | | 12/1994 | |
| WO | WO 94/28102 | A1 | | 12/1994 | |
| WO | WO 94/28103 | A1 | | 12/1994 | |
| WO | WO 95/00626 | A1 | | 1/1995 | |
| WO | WO 95/07303 | A1 | | 3/1995 | |
| WO | WO 95/12619 | A1 | | 5/1995 | |
| WO | WO 95/14075 | A1 | | 5/1995 | |
| WO | WO 95/14759 | A1 | | 6/1995 | |
| WO | WO 95/17498 | A1 | | 6/1995 | |
| WO | WO 95/20029 | A1 | | 7/1995 | |
| WO | WO 95/20608 | A1 | | 8/1995 | |
| WO | WO 95/27775 | A1 | | 10/1995 | |
| WO | WO 98/12299 | A1 | | 3/1998 | |
| WO | WO 98/40462 | A1 | | 9/1998 | |
| WO | WO 98/40463 | A1 | | 9/1998 | |
| WO | WO 98/55583 | A1 | | 12/1998 | |
| WO | WO 98/55590 | A1 | | 12/1998 | |

OTHER PUBLICATIONS

R.C. MacKenzie and B.D. Mitchell, "Differential Thermal Analysis, A Review", The Analyst, vol. 87, (Jun., 1962), pp. 420–434.

"Tablettensprengmittel", Römpp Chemilexikon, 9th Ed., vol. 6, (1992), p. 4440, NT; NMG.

Voigt, "Lehrbuch der pharmazeutischen Technologie" (Textbook of Pharmaceutical Technology), 6th Ed., (1987), pp. 182–184, NT; NMG.

* cited by examiner

HYDROXY MIXED ETHERS AND POLYMERS IN THE FORM OF SOLID PREPARATIONS AS A STARTING COMPOUND FOR LAUNDRY DETERGENTS, DISHWASHING DETERGENTS AND CLEANING COMPOSITIONS

CROSS-REFERENCE TO RELATED APPLICATIONS

This application claims the benefit of German patent application serial number 101 63 856.6, filed on Dec. 22, 2001, the entire contents of which are incorporated herein by reference.

BACKGROUND OF THE INVENTION

This invention relates to solid preparations containing hydroxy mixed ethers and optionally other surfactants, polymers and inorganic or organic carriers, to a process for their production and to the use of the solid preparations as a starting compound for the production of laundry detergents, dishwashing detergents and cleaning compositions.

Today, machine-washed tableware has to meet stringent requirements. Thus, even tableware completely free from food residues is regarded as unsatisfactory when, after dishwashing, it still has whitish stains which are attributable to water hardness or other mineral salts and which come from water droplets that have remained on the tableware through lack of wetting agent and dried. Accordingly, to obtain bright, spotless tableware, rinse agents have to be used. The addition of liquid or solid rinse agent—which may be separately added or which is already present in ready-to-use form together with the detergent and/or regenerating salt ("2-in-1", "3-in-1", for example in the form of tablets and powders)—ensures that the water drains completely from the tableware so that the various surfaces are bright and free from residues at the end of the dishwashing program.

Commercially available rinse agents are mixtures of, for example, nonionic surfactants, solubilizers, organic acids and solvents, water and optionally preservative and perfumes. The function of the surfactants in these compositions is to influence the interfacial tension of the water in such a way that it is able to drain from the tableware as a thin, coherent film so that no droplets of water, streaks or films remain behind during the subsequent drying process (so-called wetting effect). Accordingly, another function of surfactants in rinse agents is to suppress the foam generated by food residues in the dishwashing machine. Since the rinse agents generally contain acids to improve the clear drying effect, the surfactants used also have to be relatively hydrolysis-resistant towards acids.

Rinse agents are used both in the home and in the institutional sector. In domestic dishwashers, the rinse agent is added after the prerinse and wash cycle at 40 to 65° C. Institutional dishwashers use only one wash liquor which is merely replenished by addition of the rinse agent solution from the preceding wash cycle. Accordingly, there is no complete replacement of water in the entire dishwashing program. Because of this, the rinse agent is also expected to have a foam-suppressing effect, to be temperature-stable in the event of a marked drop in temperature from 85 to 35° C. and, in addition, to be satisfactorily resistant to alkali metal and active chlorine compounds.

Reference is made in this connection to DE-A1 19738866 (Cognis) which describes surfactant mixtures containing nonionic surfactants of the hydroxy mixed ether and fatty alcohol polyglycol ether type which have very good foaming behavior and show excellent clear rinse effects in rinse agents.

The problem addressed by the present invention was to provide surfactants in solid form (solid preparations) for the production of solid laundry detergents, dishwashing detergents and cleaning compositions, more particularly solid dishwashing detergents, for example so-called "2-in-1" or "3-in-1" dishwashing detergents. The solid preparations would be distinguished by excellent "clear rinse" properties, by a foam-suppressing effect even in the presence of protein-containing soils, by stability even in the event of significant reductions in temperature, by dissolution without gelling and, in particular, by dissolving kinetics which would ensure that a high percentage of the nonionic surfactant was carried over into the rinse cycle of the machine program. In addition, it would be possible to produce solid cleaning formulations more easily. Also, the surfaces to be cleaned or rinsed would be finished in such a way that soil would be easier to remove in the next cleaning cycle.

The problem stated above has been solved by the provision of solid preparations which contain a combination of hydroxy mixed ethers and polymers in the mixing ratio according to the invention. Through the provision of these solid preparations, for example as a starting compound for laundry detergent, dishwashing detergent and cleaning formulations, the surfactant content and particularly the hydroxy mixed ether content can be reduced for the same high cleaning performance.

Nevertheless, very good wettability and a spotless shine of the surfaces to be cleaned are obtained in this way. The effect of adding polymers to rinse agents is that otherwise firmly adhering and often critical soils, for example starch-containing soils, can be completely removed in the next cleaning cycle. Such soils can be removed without additional manual treatment of the tableware.

BRIEF SUMMARY OF THE INVENTION

A solid composition is comprised of (a) a hydroxy mixed ether of the formula (I):

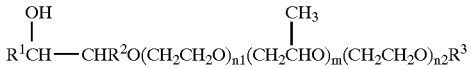

$$R^1\overset{\overset{OH}{|}}{C}H-CHR^2O(CH_2CH_2O)_{n1}(CH_2\overset{\overset{CH_3}{|}}{C}HO)_m(CH_2CH_2O)_{n2}R^3 \quad (I)$$

wherein $R^1$ is a linear or branched alkyl group having from 2 to 18 carbon atoms, $R^2$ is hydrogen or a linear or branched alkyl group having from 2 to 18 carbon atoms, $R^3$ is a linear or branched alkyl and/or alkenyl group having from 1 to 22 carbon atoms, each of n1 and n2 independently is a number from 0 to 60 and m is 0 or a number from about 0.5 to about 5, with the provisos that the total number of carbon atoms in the substituents $R^1$ and $R^2$ is at least 6 and the sum (n1+m+n2) is greater than 0; and (b) a polymer. The compositions according to the invention can optionally contain additional nonionic surfactants, (c) auxiliaries and additives typically found in laundry detergents, dishwashing detergents and cleaning compositions and (d) carriers. When these optional materials are present, the weight ratio of (a+b+c)/(d) is equal to from about 1:1 to about 1:40. The compositions according to the invention are useful for the production of dishwashing, laundry and cleaning compositions.

BRIEF DESCRIPTION OF THE SEVERAL VIEWS OF THE DRAWING

Not applicable.

DETAILED DESCRIPTION OF THE INVENTION

Hydroxy mixed ethers (HMEs) are known nonionic surfactants with a nonsymmetrical ether structure and a content of polyalkylene glycols which are obtained, for example, by subjecting olefin epoxides to a ring opening reaction with fatty alcohol polyglycol ethers. Corresponding products and their use in the cleaning of hard surfaces are the subject of, for example, European patent EP 0 693 049 B1 and International patent application WO 94/22800 (Olin) and the documents cited therein.

The hydroxy mixed ethers preferably correspond to general formula (I):

$$R^1\overset{\overset{\displaystyle OH}{|}}{C}H-CHR^2O(CH_2CH_2O)_{n1}(CH_2\overset{\overset{\displaystyle CH_3}{|}}{C}HO)_m(CH_2CH_2O)_{n2}R^3 \quad (I)$$

in which $R^1$ is a linear or branched alkyl group containing 2 to 18, preferably 6 to 16 carbon atoms and more particularly 8 to 12 carbon atoms, $R^2$ is hydrogen or a linear or branched alkyl group containing 2 to 18 carbon atoms, $R^3$ is a linear or branched alkyl and/or alkenyl group containing 1 to 22 and preferably 8 to 18 carbon atoms, n1 and n2 independently of one another are 0 or numbers of 1 to 60, preferably 2 to 60 and more particularly 20 to 40 and m is 0 or a number of 0.5 to 5 and preferably 1 to 2, with the provisos that the total number of carbon atoms in the substituents $R^1$ and $R^2$ is at least 6 and preferably 8 to 18 and the sum (n1+m+n2) is not 0.

As the formula suggests, the HMEs may be ring opening products both of internal olefins ($R^2 \neq$hydrogen) or terminal olefins ($R^2$=hydrogen), the latter being preferred for their more favorable performance properties and their easier production. Similarly, the polar part of the molecule may be a polyethylene (PE) or a polypropylene (PP) chain. Mixed chains of PE and PP units in statistical or block distribution are also suitable. Typical examples are ring opening products of 1,2-hexene epoxide, 2,3-hexene epoxide, 1,2-octene epoxide, 2,3-octene epoxide, 3,4-octene epoxide, 1,2-decene epoxide, 2,3-decene epoxide, 3,4-decene epoxide, 4,5-decene epoxide, 1,2-dodecene epoxide, 2,3-dodecene epoxide, 3,4-dodecene epoxide, 4,5-dodecene epoxide, 5,6-dodecene epoxide, 1,2-tetradecene epoxide, 2,3-tetradecene epoxide, 3,4-tetradecene epoxide, 4,5-tetradecene epoxide, 5,6-tetradecene epoxide, 6,7-tetradecene epoxide, 1,2-hexadecene epoxide, 2,3-hexadecene epoxide, 3,4-hexadecene epoxide, 4,5-hexadecene epoxide, 5,6-hexadecene epoxide, 6,7-hexadecene epoxide, 7,8-hexadecene epoxide, 1,2-octadecene epoxide, 2,3-octadecene epoxide, 3,4-octadecene epoxide, 4,5-octadecene epoxide, 5,6-octadecene epoxide, 6,7-octadecene epoxide, 7,8-octadecene epoxide and 8,9-octadecene epoxide and mixtures thereof with addition products of on average 1 to 50, preferably 2 to 40 and more particularly 5 to 20 mol ethylene oxide and/or 1 to 10, preferably 2 to 8 and more particularly 3 to 5 mol propylene oxide onto saturated and/or unsaturated primary alcohols containing 6 to 22 and preferably 12 to 18 carbon atoms, such as for example caproic alcohol, caprylic alcohol, 2-ethyl hexyl alcohol, capric alcohol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, linolyl alcohol, linolenyl alcohol, elaeostearyl alcohol, arachyl alcohol, gadoleyl alcohol, behenyl alcohol, erucyl alcohol and brassidyl alcohol and technical mixtures thereof.

Hydroxy mixed ethers which have proved to be particularly suitable from the performance perspective correspond to formula (I) in which

- $R^1$ is a linear alkyl group containing 8 to 10 carbon atoms, $R^2$ is hydrogen, $R^3$ is a linear alkyl group containing 8 to 10 carbon atoms, n1=0, m is a number of 0.5 to 2 and n2 is a number of 20 to 40.
- $R^1$ is a linear alkyl group containing 8 to 10 carbon atoms, $R^2$ is hydrogen, $R^3$ is a branched alkyl group containing 8 to 10 carbon atoms, n1 and m=0 and n2 is a number of 20 to 40;
- $R^1$ is a linear alkyl group containing 8 to 10 carbon atoms, $R^2$ is hydrogen, $R^3$ is a linear alkyl group containing 8 to 10 carbon atoms, n1 and m are 0 and n2 is a number of 40 to 60.

Polymers

The polymers used are cationic polymers are, for example, cationic cellulose derivatives such as, for example, the quaternized hydroxyethyl cellulose obtainable from Amerchol under the name of Polymer JR 400®, cationic starch, copolymers of diallyl ammonium salts and acrylamides, quaternized vinyl pyrrolidone/vinylimidazole polymers such as, for example, Luviquat® (BASF), condensation products of polyglycols and amines, quaternized collagen polypeptides such as, for example, Lauryldimonium Hydroxypropyl Hydrolyzed Collagen (Lamequat® L, Grünau), quaternized wheat polypeptides, polyethyleneimine, cationic silicone polymers such as, for example, amodimethicone, copolymers of adipic acid and dimethylamino-hydroxypropyl diethylenetriamine (Cartaretine®, Sandoz), copolymers of acrylic acid with dimethyl diallyl ammonium chloride (Merquat® 550, Chemviron), polyaminopolyamides as described, for example, in FR 2 252 840 A and crosslinked water-soluble polymers thereof, cationic chitin derivatives such as, for example, quaternized chitosan, optionally in microcrystalline distribution, condensation products of dihaloalkyls, for example dibromobutane, with bis-dialkylamines, for example bis-dimethylamino-1,3-propane, cationic guar gum such as, for example, Jaguar® CBS, Jaguar® C-17, Jaguar® C-16 of Celanese, quaternized ammonium salt polymers such as, for example, Mirapol® A-15, Mirapol® AD-1, Mirapol® AZ-1 of Miranol.

A preferred embodiment is characterized by the presence of polymers selected from the group consisting of polymers or copolymers of monomers such as trialkylammonium alkyl (meth)acrylate or acrylamide, dialkyldiallyl diammonium salts, polymer analog reaction products of ethers or esters of polysaccharides containing ammonium side groups, guar, cellulose and starch derivatives, polyadducts of ethylene oxide with ammonium groups, polyesters and polyamides containing quaternary side groups. It is particularly preferred to use polyacrylic acid copolymers, for example Versicol®) E11 or Glascol® E11 (Allied Colloids), polyacrylamido-propanesulfonic acid, for example Rheothik® 80-11 (Cognis), trimethyl ammonium propyl methacrylamide sodium acrylate/ethyl acrylate polymer, for example Polyquart® Ampho 149 (Cognis). Quaternized protein hydrolyzates, for example Gluadin® WQ (Cognis), are also preferred.

Anionic, zwitterionic, amphoteric and nonionic polymers may also be used. Suitable anionic, zwitterionic, amphoteric and nonionic polymers are, for example, vinyl acetate/crotonic acid copolymers, vinyl pyrrolidone/vinyl acrylate copolymers, vinyl acetate/butyl maleate/isobornyl acrylate copolymers, methyl vinylether/maleic anhydride copolymers and esters thereof, uncrosslinked and polyol-crosslinked polyacrylic acids, acrylamidopropyl trimethylammonium chloride/acrylate copolymers, octylacrylamide/methyl methacrylate/tert.-butylaminoethyl methacrylate/2-hydroxypropyl methacrylate copolymers, polyvinyl pyrrolidone, vinyl pyrrolidone/vinyl acetate copolymers, vinyl pyrrolidone/dimethylaminoethyl methacrylate/vinyl caprolactam terpolymers and optionally derivatized cellulose ethers and silicones. Other suitable polymers are mentioned in Cosm. Toil. 108, 95 (1993).

In a preferred embodiment of the invention, the solid preparations contain cationic polymers which have monomer units corresponding to formula (Ia):

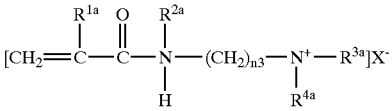

(Ia)

where n3 is a number of 2 to 4, preferably 3, $R^{1a}$ is hydrogen or a methyl group and $R^{2a}$, $R^{3a}$ and $R^{4a}$ may be the same or different and represent hydrogen or a $C_{1-4}$ alk(en)yl group, X is an anion from the group of halide anions or a monoalkyl anion of sulfuric acid semiester.

The polymers contain the monomer units of formula (Ia) in a quantity of preferably 10 mol-% to 80 mol-% and more particularly 20 mol-% to 60 mol-%. The polymers thus have a significant soil release effect.

Besides the monomer units corresponding to formula (Ia), unsaturated monocarboxylic acids, such as acrylic acid, methacrylic acid, crotonic acid and the like, olefins, such as ethylene, propylene and butene, alkylesters of unsaturated carboxylic acids, more particularly esters of acrylic acid and methacrylic acid of which the alcohol components contain $C_{1-6}$ alkyl groups, such as methyl acrylate, ethyl acrylate, methyl methacrylate and hydroxy derivatives thereof, such as 2-hydroxyethyl methacrylate, aromatic compounds containing unsaturated groups and optionally other substituents, such as styrene, methylstyrene, vinylstyrene, and heterocyclic compounds, such as vinyl pyrrolidone, may be used as comonomers. Acrylic acid, methacrylic acid and $C_{1-6}$ esters thereof are preferably used as comonomers.

It is also preferred to use soil-repellent polymers (soil repellants). Suitable soil repellants are substances which preferably contain ethylene terephthalate and/or polyethylene glycol terephthalate groups, the molar ratio of ethylene terephthalate to polyethylene glycol terephthalate being in the range from 50:50 to 90:10. The molecular weight of the linking polyethylene glycol units is more particularly in the range from 750 to 5,000, i.e. the degree of ethoxylation of the polymers containing polyethylene glycol groups may be about 15 to 100. The polymers are distinguished by an average molecular weight of about 5,000 to 200,000 and may have a block structure, but preferably have a random structure. Preferred polymers are those with molar ethylene terephthalate: polyethylene glycol terephthalate ratios of about 65:35 to about 90:10 and preferably in the range from about 70:30 to 80:20. Other preferred polymers are those which contain linking polyethylene glycol units with a molecular weight of 750 to 5,000 and preferably in the range from 1,000 to about 3,000 and which have a molecular weight of the polymer of about 10,000 to about 50,000. Examples of commercially available polymers are the products Milease® T (ICI) or Repelotex® SRP 3 (Rhône-Poulenc).

In another preferred embodiment, the preparations according to the invention contain the components hydroxy mixed ethers and polymers in a ratio by weight of from about 0.1:1 to about 1,000:1, preferably from about 1:1 to about 100:1 and more particularly from about 5:1 to about 20:1.

Inorganic or Organic Carriers

In a preferred embodiment, the solid preparations contain inorganic or organic carriers selected from the group consisting of zeolites, alkali metal sulfates, alkali metal phosphates, alkali metal carbonates, alkali metal hydrogen carbonates, alkali metal silicates, alkali metal citrates, polysaccharides and derivatives thereof, such as celluloses, carboxymethyl celluloses, cyclodextrins, starches, starch degradation products and polyacrylates and mixtures thereof.

Zeolites

Among the zeolites, the detergent builders zeolite A and/or zeolite P are particularly preferred. Zeolite MAP® (Crosfield) is a particularly preferred P-type zeolite. However, zeolite X and mixtures of A, X and/or P and also Y are also suitable. A co-crystallized sodium/potassium aluminum silicate of zeolite A and zeolite X commercially available as VEGOBOND AX® (from Condea Augusta S.p.A.) is also of particular interest. The zeolite may be used in the form of a spray-dried powder or even in the form of an undried stabilized suspension still moist from its production. Where the zeolite is used in the form of a suspension, the suspension may contain small additions of nonionic surfactants as stabilizers, for example 1 to 3% by weight, based on zeolite, of ethoxylated $C_{12-18}$ fatty alcohols containing 2 to 5 ethylene oxide groups, $C_{12-14}$ fatty alcohols containing 4 to 5 ethylene oxide groups or ethoxylated isotridecanols. Suitable zeolites have a mean particle size of less than 10 $\mu$m (volume distribution, as measured by the Coulter Counter method) and contain preferably 18 to 22% by weight and more preferably 20 to 22% by weight of bound water.

Alkali Metal Phosphates

Besides the Zeolites, the generally known phosphates in particular may be used as carriers, the sodium salts of the orthophosphates, pyrophosphates and in particular the tripolyphosphates being particularly suitable.

Alkali Metal Silicates

Alkali metal silicates are understood to be crystalline layer alkali metal and particularly sodium silicates corresponding to the general formula $NaMSi_xO_{2x+1} \cdot yH_2O$, where M is sodium or hydrogen, x is a number of 1.9 to 4 and y is a number of 0 to 20, preferred values for x being 2, 3 or 4. Crystalline layer silicates such as these are described, for example, in European patent application EP 0 164 514 A1. Preferred crystalline layer silicates corresponding to the above formula are those in which M is sodium and x assumes the value 2 or 3. Both β- and δ-sodium disilicates $Na_2Si_2O_5 \cdot yH_2O$ are particularly preferred, β-sodium disilicate being obtainable, for example, by the process described in International patent application WO 91/08171. Other suitable layer silicates are known, for example, from patent applications DE 2334899 A1, EP 0026529 A1 and DE 3526405 A1. The suitability of these layer silicates is not limited to a particular composition or structural formula. However, smectites, more especially bentonites, are preferred for the purposes of the present invention. Suitable layer silicates which belong to the group of water-swellable smectites are, for example, those corresponding to the following general formulae:

$(OH)_4Si_{8-y}Al_y(Mg_xA_{4-x})O_{20}$ montmorillonite $(OH)_4Si_{8-y}Al_y(Mg_{6-z}Li_z)O_{20}$ hectorite $(OH)_4Si_{8-y}Al_y(Mg_{6-z}Al_z)O_{20}$ saponite where x=0 to 4, y=0 to 2 and z=0 to 6. Small amounts of iron may additionally be incorporated in the crystal lattice of the layer silicates corresponding to the above formulae. In addition, by virtue of their ion-exchanging properties, the layer silicates may contain hydrogen, alkali metal and alkaline-earth metal ions, more particularly $Na^+$ and $Ca^{2+}$. The quantity of water of hydration is generally in the range from 8 to 20% by weight and is dependent upon the degree of swelling or upon the treatment method. Suitable layer silicates are known, for example, from U.S. Pat. No. 3,966,629 U.S. Pat. No. 4,062,647, EP 0026529 A1 and EP 0028432 A1. Layer silicates which, by virtue of an alkali treatment, are largely free from calcium ions and strongly coloring iron ions are preferably used. Other preferred inorganic carrier materials are amorphous sodium silicates with a modulus ($Na_2O:SiO_2$ ratio) of 1:2 to 1:3.3, preferably 1:2 to 1:2.8 and more preferably 1:2 to 1:2.6 which dissolve with delay and exhibit multiple wash cycle properties. The delay in dissolution in relation to conventional amorphous sodium silicates can have been obtained in various ways, for example by surface treatment, compounding, compacting or by overdrying. In the context of the invention, the term "amorphous" is also understood to encompass "X-ray amorphous". In other words, the silicates do not produce any of the sharp X-ray reflexes typical of crystalline substances in X-ray diffraction experiments, but at best one or more maxima of the scattered X-radiation which have a width of several degrees of the diffraction angle. However, particularly good performance properties may even be achieved where the silicate particles produce crooked or even sharp diffraction maxima in electron diffraction experiments. This may be interpreted to mean that the products have microcrystalline regions between 10 and a few hundred nm in size, values of up to at most 50 nm and, more particularly, up to at most 20 nm being preferred. So-called X-ray amorphous silicates such as these, which also dissolve with delay in relation to conventional waterglasses, are described for example in German patent application DE-A4400024 A1. Compacted amorphous silicates, compounded amorphous silicates and overdried X-ray-amorphous silicates are particularly preferred.

Examples of polysaccharides are cellulose, carboxymethyl cellulose, cyclodextrin or starch and degradation products thereof, polyacrylates with molecular weights of 1,000 to 50,000 being particularly suitable polymeric carriers (d).

A distinction is drawn with regard to content between the polymers (b) and other polymers used as carriers (d) and polymers as auxiliaries and additives (c). This distinction has to be taken into account when calculating percentages by weight and quantity ratios.

Besides the hydroxy mixed ethers, the polymers and the carriers, the solid preparations may contain other auxiliaries and additives typical of laundry detergents, dishwashing detergents and cleaning compositions and also other surfactants. Apart from the carriers which can also act as builders, these include, for example, low-foaming, preferably nonionic co-surfactants, anionic co-surfactants, co-builders, oil- and fat-dissolving substances, bleaching agents, bleach activators, redeposition inhibitors, enzymes, enzyme stabilizers, optical brighteners, defoamers, disintegrators, perfumes, inorganic salts and the like, as explained in more detail in the following.

Nonionic Co-Surfactants

Solid preparations containing nonionic surfactants in addition to the hydroxy mixed ether of the formula (I), particularly addition products of ethylene oxide and/or propylene oxide onto fatty or oxo alcohols, as a further surfactant component besides the hydroxy mixed ethers are particularly preferred. Typical examples of nonionic co-surfactants are fatty alcohol polyglycol ethers, alkylphenol polyglycol ethers, fatty acid polyglycol esters, fatty acid amide polyglycol ethers, fatty amine polyglycol ethers, alkoxylated triglycerides, mixed ethers and mixed formals, alk(en)yl oligoglycosides, fatty acid-N-alkyl glucamides, protein hydrolyzates (more particularly wheat-based vegetable products), polyol fatty acid esters, sugar esters, sorbitan esters, polysorbates and amine oxides. If the nonionic surfactants contain polyglycol ether chains, the polyglycol ether chains may have a conventional homolog distribution, although they preferably have a narrow homolog distribution. Fatty alcohol polyglycol ethers, alkoxylated fatty acid lower alkyl esters, alkyl oligoglycosides or mixed ethers are preferably used.

Preferred fatty alcohol polyglycol ethers correspond to formula (II):

$$R^4O(CH_2CHR^5O)_{p1}H \quad \text{(II)}$$

in which $R^4$ is a linear or branched alkyl and/or alkenyl group containing 6 to 22 and preferably 12 to 18 carbon atoms, $R^5$ is hydrogen or methyl and p1 is a number of 1 to 20. Typical examples are products of the addition of, on average, 1 to 20 and preferably 5 to 10 mol ethylene and/or propylene oxide onto caproic alcohol, caprylic alcohol, 2-ethylhexyl alcohol, capric alcohol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, linolyl alcohol, linolenyl alcohol, elaeostearyl alcohol, arachyl alcohol, gadoleyl alcohol, behenyl alcohol, erucyl alcohol and brassidyl alcohol and technical mixtures thereof. Products of the addition of 3, 5 or 7 mol ethylene oxide onto technical cocofatty alcohols are particularly preferred.

Suitable alkoxylated fatty acid lower alkyl esters are surfactants corresponding to formula (III):

$$R^6CO—(OCH_2CHR^7)_{p2}OR^8 \quad \text{(III)}$$

in which $R^6CO$ is a linear or branched, saturated and/or unsaturated acyl group containing 6 to 22 carbon atoms, $R^7$ is hydrogen or methyl, $R^8$ is a linear or branched alkyl group containing 1 to 4 carbon atoms and p2 is a number of 1 to 20. Typical examples are the formal insertion products of, on average, 1 to 20 and preferably 5 to 10 mol ethylene and/or propylene oxide into the methyl, ethyl, propyl, isopropyl, butyl and tert.butyl esters of caproic acid, caprylic acid, 2-ethylhexanoic acid, capric acid, lauric acid, isotridecanoic acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and technical mixtures thereof. The products are normally prepared by insertion of the alkylene oxides into the carbonyl ester bond in the presence of special catalysts, for example calcined hydrotalcite. Reaction products of on average 5 to 10 mol ethylene oxide into the ester bond of technical cocofatty acid methyl esters are particularly preferred.

Alkyl and alkenyl oligoglycosides, which are also preferred nonionic surfactants, normally correspond to formula (IV):

$$R^9O\text{-}[G]_q \quad (IV)$$

in which $R^9$ is an alkyl and/or alkenyl group containing 4 to 22 carbon atoms, G is a sugar unit containing 5 or 6 carbon atoms and p is a number of 1 to 10. They may be obtained by the relevant methods of preparative organic chemistry. EP 0301298 A1 and WO 90/03977 are cited as representative of the extensive literature available on the subject. The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides. The index q in general formula (IV) indicates the degree of oligomerization (DP), i.e. the distribution of mono- and oligoglycosides, and is a number of 1 to 10. Whereas q in a given compound must always be an integer and, above all, may assume a value of 1 to 6, the value q for a certain alkyl oligoglycoside is an analytically determined calculated quantity which is generally a broken number. Alkyl and/or alkenyl oligoglycosides having an average degree of oligomerization q of 1.1 to 3.0 are preferably used. Alkyl and/or alkenyl oligoglycosides having a degree of oligomerization of less than 1.7 and, more particularly, between 1.2 and 1.4 are preferred from the applicational point of view. The alkyl or alkenyl radical $R^9$ may be derived from primary alcohols containing 4 to 11 and preferably 8 to 10 carbon atoms. Typical examples are butanol, caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis. Alkyl oligoglucosides having a chain length of $C_8$ to $C_{10}$ (DP=1 to 3), which are obtained as first runnings in the separation of technical $C_{8-18}$ coconut oil fatty alcohol by distillation and which may contain less than 6% by weight of $C_{12}$ alcohol as an impurity, and also alkyl oligoglucosides based on technical $C_{9/11}$ oxoalcohols (DP=1 to 3) are preferred. In addition, the alkyl or alkenyl radical $R^9$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol and technical mixtures thereof which may be obtained as described above. Alkyl oligoglucosides based on hydrogenated $C_{12/14}$ cocoalcohol with a DP of 1 to 3 are preferred.

Other preferred nonionic surfactants are mixed ethers corresponding, for example, to formula (V):

$$R^{10}O(CH_2CH_2O)_{r1}(CH(CH_3)CH_2O)_s(CH_2CH_2O)_{r2}R^{11} \quad (V)$$

in which $R^{10}$ is a linear or branched alkyl and/or alkenyl group containing 6 to 22 and preferably 12 to 18 carbon atoms, $R^{11}$ is an alkyl group containing 1 to 8 carbon atoms or a benzyl group, r1 and r2 independently of one another are 0 or numbers of 1 to 20 and s is 0 or a number of 0.5 to 5, with the proviso that the sum (r1+r2+s) must not be 0. Typical examples are coconut fatty alcohol+10EO butyl ether, coconut fatty alcohol+5PO+4EO butyl ether or coconut fatty alcohol+10EO benzyl ether.

Anionic Co-Surfactants

Typical examples of anionic co-surfactants are soaps, alkyl benzenesulfonates, secondary alkane sulfonates, olefin sulfonates, alkyl ether sulfonates, glycerol ether sulfonates, a-methyl ester sulfonates, sulfofatty acids, alkyl and/or alkenyl sulfates, alkyl ether sulfates, glycerol ether sulfates, hydroxy mixed ether sulfates, monoglyceride (ether) sulfates, fatty acid amide (ether) sulfates, mono- and dialkyl sulfosuccinates, mono- and dialkyl sulfosuccinamates, sulfotriglycerides, amide soaps, ether carboxylic acids and salts thereof, fatty acid isethionates, fatty acid sarcosinates, fatty acid taurides, N-acylamino acids such as, for example, acyl lactylates, acyl tartrates, acyl glutamates and acyl aspartates, alkyl oligoglucoside sulfates, protein fatty acid condensates (particularly wheat-based vegetable products) and alkyl (ether) phosphates. If the anionic surfactants contain polyglycol ether chains, the polyglycol ether chains may have a conventional homolog distribution, although they preferably have a narrow homolog distribution. In a particularly preferred embodiment, the surfactant mixtures may contain anionic surfactants selected from the group consisting of alkyl and/or alkenyl sulfates, alkyl ether sulfates, alkyl benzenesulfonates, monoglyceride (ether) sulfates and alkanesulfonates, more particularly fatty alcohol sulfates, fatty alcohol ether sulfates, secondary alkanesulfonates and linear alkyl benzenesulfonates.

Alkyl and/or Alkenyl Sulfates

Alkyl and/or alkenyl sulfates, which are often also referred to as fatty alcohol sulfates, are understood to be the sulfation products of primary alcohols which correspond to formula (VIII):

$$R^{16}O\text{—}SO_3X \quad (VIII)$$

in which $R^{16}$ is a linear or branched, aliphatic alkyl and/or alkenyl group containing 6 to 22 carbon atoms and preferably 12 to 18 carbon atoms and X is an alkali metal and/or alkaline earth metal, ammonium, alkyl ammonium, alkanolammonium or glucammonium. Typical examples of alkyl sulfates which may be used in accordance with the invention are the sulfation products of caproic alcohol, caprylic alcohol, capric alcohol, 2-ethyl hexyl alcohol, lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol and erucyl alcohol and the technical mixtures thereof obtained by high-pressure hydrogenation of technical methyl ester fractions or aldehydes from Roelen's oxo synthesis. The sulfation products may advantageously be used in the form of their alkali metal salts and particularly their sodium salts. Alkyl sulfates based on $C_{16/18}$ tallow fatty alcohols or vegetable fatty alcohols of comparable C chain distribution in the form of their sodium salts are particularly preferred.

Alkyl Ether Sulfates

Alkyl ether sulfates ("ether sulfates") are known anionic surfactants which, on an industrial scale, are produced by $SO_3$ or chlorosulfonic acid (CSA) sulfation of fatty alcohol or oxoalcohol polyglycol ethers and subsequent neutralization. Ether sulfates suitable for use in accordance with the invention correspond to formula (IX):

$$R^{17}O\text{—}(CH_2CH_2O)_aSO_3X \quad (IX)$$

in which $R^{17}$ is a linear or branched alkyl and/or alkenyl group containing 6 to 22 carbon atoms, a is a number of 1 to 10 and X is an alkali metal and/or alkaline earth metal, ammonium, alkylammonium, alkanolammonium or glucammonium. Typical examples are the sulfates of addition products of on average 1 to 10 and more particularly 2 to 5 mol ethylene oxide onto caproic alcohol, caprylic alcohol, 2-ethylhexyl alcohol, capric alcohol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol and brassidyl alcohol and technical mixtures thereof in the form of their sodium and/or magnesium salts. The ether sulfates may have both a conventional homolog distribution and a narrow homolog distribution. It is particularly preferred to use ether sulfates based on adducts of on average 2 to 3 mol ethylene oxide with technical $C_{12/14}$ or $C_{12/18}$ coconut fatty alcohol fractions in the form of their sodium and/or magnesium salts.

Co-Builders

Useful organic builders suitable as co-builders are, for example, the polycarboxylic acids usable in the form of their sodium salts, such as citric acid, adipic acid, succinic acid, glutaric acid, tartaric acid, sugar acids, aminocarboxylic acids, nitrilotriacetic acid (NTA), providing its use is not ecologically unsafe, and mixtures thereof. Preferred salts are the salts of the polycarboxylic acids, such as citric acid, adipic acid, succinic acid, glutaric acid, tartaric acid, sugar acids and mixtures thereof. The acids per se may also be used. Besides their building effect, the acids also typically have the property of an acidifying component and, hence, also serve to establish a relatively low and mild pH value in detergents or cleaners. Citric acid, succinic acid, glutaric acid, adipic acid, gluconic acid and mixtures thereof are particularly mentioned in this regard. Other suitable organic builders are dextrins, for example oligomers or polymers of carbohydrates which may be obtained by partial hydrolysis of starches. The hydrolysis may be carried out by standard methods, for example acid- or enzyme-catalyzed methods. The end products are preferably hydrolysis products with average molecular weights of 400 to 500,000. A polysaccharide with a dextrose equivalent (DE) of 0.5 to 40 and, more particularly, 2 to 30 is preferred, the DE being an accepted measure of the reducing effect of a polysaccharide by comparison with dextrose which has a DE of 100. Both maltodextrins with a DE of 3 to 20 and dry glucose syrups with a DE of 20 to 37 and also so-called yellow dextrins and white dextrins with relatively high molecular weights of 2,000 to 30,000 may be used. A preferred dextrin is described in British patent application GB 9419091 A1. The oxidized derivatives of such dextrins are their reaction products with oxidizing agents which are capable of oxidizing at least one alcohol function of the saccharide ring to the carboxylic acid function. Dextrins thus oxidized and processes for their production are known, for example, from European patent applications EP 0232202 A1, EP 427349 A1, EP 0472042 A1 and EP 0542496 A1 and from International patent applications WO 92/18542, WO 93/08251, WO 93/16110, WO 94/28030, WO 95/07303, WO 95/12619 and WO 95/20608. An oxidized oligosaccharide corresponding to German patent application DE 19600018 A1 is also suitable. A product oxidized at $C_6$ of the saccharide ring can be particularly advantageous. Other suitable co-builders are oxydisuccinates and other derivatives of disuccinates, preferably ethylenediamine disuccinate. The glycerol disuccinates and glycerol trisuccinates described, for example, in U.S. Pat. No. 4,524,009, in U.S. Pat. No. 4,639,325, in European patent application EP 0150930 A1 and in Japanese patent application JP 93/339896 are also particularly preferred in this connection. The quantities used in zeolite-containing and/or silicate-containing formulations are from 3 to 15% by weight. Other useful organic co-builders are, for example, acetylated hydroxycarboxylic acids and salts thereof which may optionally be present in lactone form and which contain at least 4 carbon atoms, at least one hydroxy group and at most two acid groups. Co-builders such as these are described, for example, in International patent application WO 95/20029.

Suitable polymeric polycarboxylates are, for example, the sodium salts of polyacrylic acid or polymethacrylic acid, for example those with a relative molecular weight of 800 to 150,000 (based on acid and measured against polystyrenesulfonic acid). Suitable copolymeric polycarboxylates are, in particular, those of acrylic acid with methacrylic acid and of acrylic acid or methacrylic acid with maleic acid. Acrylic acid/maleic acid copolymers containing 50 to 90% by weight of acrylic acid and 50 to 10% by weight of maleic acid have proved to be particularly suitable. Their relative molecular weight, based on free acids, is generally in the range from 5,000 to 200,000, preferably in the range from 10,000 to 120,000 and more preferably in the range from 50,000 to 100,000 (as measured against polystyrenesulfonic acid). The (co)polymeric polycarboxylates may be used either as powders or as aqueous solutions, 20 to 55% by weight aqueous solutions being preferred. Granular polymers are generally added to basic granules of one or more types in a subsequent step. Also particularly preferred are biodegradable polymers of more than two different monomer units, for example those which contain salts of acrylic acid and maleic acid and vinyl alcohol or vinyl alcohol derivatives as monomers in accordance with DE 4300772 A1 or salts of acrylic acid and 2-alkylallyl sulfonic acid and sugar derivatives as monomers in accordance with DE 4221381 C2. Other preferred copolymers are those described in German patent applications DE 4303320 A1 and DE 4417734A1 which preferably contain acrolein and acrylic acid/acrylic acid salts or acrolein and vinyl acetate as monomers. Other preferred builders are polymeric aminodicarboxylic acids, salts and precursors thereof. Polyaspartic acids and salts and derivatives thereof are particularly preferred.

Other suitable builders are polyacetals which may be obtained by reaction of dialdehydes with polyol carboxylic acids containing 5 to 7 carbon atoms and at least three hydroxyl groups, for example as described in European patent application EP 0280223 A1. Preferred polyacetals are obtained from dialdehydes, such as glyoxal, glutaraldehyde, terephthalaldehyde and mixtures thereof and from polyol carboxylic acids, such as gluconic acid and/or glucoheptonic acid.

Oil- and Fat-Dissolving Substances

In addition, the preparations may contain components with a positive effect on the removability of oil and fats from textiles by washing. Preferred oil- and fat-dissolving components include, for example, nonionic cellulose ethers, such as methyl cellulose and methyl hydroxypropyl cellulose containing 15 to 30% by weight of methoxyl groups and 1 to 15% by weight of hydroxypropoxyl groups, based on the nonionic cellulose ether, and the polymers of phthalic acid and/or terephthalic acid known from the prior art or derivatives thereof, more particularly polymers of ethylene terephthalates and/or polyethylene glycol terephthalates or anionically and/or nonionically modified derivatives thereof. Of these, the sulfonated derivatives of phthalic acid and terephthalic acid polymers are particularly preferred.

Bleaching agents and bleach activators

Among the compounds yielding $H_2O_2$ in water which serve as bleaching agents, sodium perborate tetrahydrate and sodium perborate monohydrate are particularly important. Other useful bleaching agents are, for example, sodium percarbonate, peroxypyrophosphates, citrate perhydrates and $H_2O_2$-yielding peracidic salts or peracids, such as perbenzoates, peroxophthalates, diperazelaic acid, phthaloiminoperacid or diperdodecanedioic acid. The content of peroxy bleaching agents in the preparations is preferably 5 to 35% by weight and more preferably up to 30% by weight, perborate monohydrate or percarbonate advantageously being used. Suitable bleach activators are compounds which form aliphatic peroxocarboxylic acids containing preferably 1 to 10 carbon atoms and more preferably 2 to 4 carbon atoms and/or optionally substituted perbenzoic acid under perhydrolysis conditions. Substances bearing O- and/or N-acyl groups with the number of carbon atoms mentioned and/or optionally substituted benzoyl groups are suitable. Preferred bleach activators are polyacylated alkylenediamines, more particularly tetraacetyl ethylenediamine (TAED), acylated triazine derivatives, more particularly 1,5-diacetyl-2,4-dioxohexahydro-1,3,5-triazine (DADHT), acylated glycolurils, more particularly tetraacetyl glycoluril (TAGU), N-acylimides, more particularly N-nonanoyl succinimide (NOSI), acylated phenol sulfonates, more particularly n-nonanoyl or isononanoyloxybenzenesulfonate (n- or iso-NOBS), carboxylic anhydrides, more particularly phthalic anhydride, acylated polyhydric alcohols, more particularly triacetin, ethylene glycol diacetate, 2,5-diacetoxy-2,5-dihydrofuran and the enol esters known from German patent applications DE 19616693 A1 and DE 19616767 A1, acetylated sorbitol and mannitol and the mixtures thereof (SORMAN) described in European patent application EP 0525239 A1, acylated sugar derivatives, more particularly pentaacetyl glucose (PAG), pentaacetyl fructose, tetraacetyl xylose and octaacetyl lactose, and acetylated, optionally N-alkylated glucamine and gluconolactone, and/or N-acylated lactams, for example N-benzoyl caprolactam, which are known from International patent applications WO 94/27970, WO 94/28102, WO 94/28103, WO 95100626, WO 95114759 and WO 95/17498. The substituted hydrophilic acyl acetals known from German patent application DE 19616769 A1 and the acyl lactams described in German patent application DE 19616770 and in International patent application WO 95/14075 are also preferably used. The combinations of conventional bleach activators known from German patent application DE 4443177 A1 may also be used. Bleach activators such as these are present in the usual quantities, preferably in quantities of 1% by weight to 10% by weight and more preferably in quantities of 2% by weight to 8% by weight, based on the preparation as a whole. In addition to or instead of the conventional bleach activators mentioned above, the sulfonimines known from European patents EP 0446982 B1 and EP 0453003 B1 and/or bleach-boosting transition metal salts or transition metal complexes may also be present as so-called bleach catalysts. Suitable transition metal compounds include, in particular, the manganese-, iron-, cobalt-, ruthenium- or molybdenum-salen complexes known from German patent application DE 19529905 A1 and the N-analog compounds thereof known from German patent application DE 19620267 A1, the manganese-, iron-, cobalt-, ruthenium- or molybdenum-carbonyl complexes known from German patent application DE 19536082 A1, the manganese, iron, cobalt, ruthenium, molybdenum, titanium, vanadium and copper complexes with nitrogen-containing tripod ligands described in German patent application DE 19605688 A1, the cobalt-, iron-, copper- and ruthenium-ammine complexes known from German patent application DE 19620411 A1, the manganese, copper and cobalt complexes described in German patent application DE 4416438 A1, the cobalt complexes described in European patent application EP 0272030 A1, the manganese complexes known from European patent application EP 0693550 A1, the manganese, iron, cobalt and copper complexes known from European patent EP 0 392592 A1 and/or the manganese complexes described in European patent EP 0443651 B1 or in European patent applications EP 0458397 A1, EP 0458398 A1, EP 0549271 A1, EP 0549272 A1, EP 0544490 A1 and EP 0544519 A1. Combinations of bleach activators and transition metal bleach catalysts are known, for example, from German patent application DE 19613103 A1 and from international patent application WO 95/27775. Bleach-boosting transition metal complexes, more particularly with the central atoms Mn, Fe, Co. Cu, Mo. V, Ti and/or Ru, are used in typical quantities, preferably in a quantity of up to 1% by weight, more preferably in a quantity of 0.0025% by weight to 0.25% by weight and most preferably in a quantity of 0.01% by weight to 0.1% by weight, based on the preparation as a whole.

Enzymes and Enzyme Stabilizers

Suitable enzymes are, in particular, enzymes from the class of hydrolases, such as proteases, esterases, lipases or lipolytic enzymes, amylases, cellulases or other glycosyl hydrolases and mixtures thereof. All these hydrolases contribute to the removal of stains, such as protein-containing, fat-containing or starch-containing stains, and discoloration in the washing process. Cellulases and other glycosyl hydrolases can contribute towards color retention and towards increasing fabric softness by removing pilling and microfibrils. Oxidoreductases may also be used for bleaching and for inhibiting dye transfer. Enzymes obtained from bacterial strains or fungi, such as *Bacillus subtilis, Bacillus licheniformis, Streptomyces griseus* and *Humicola insolens* are particularly suitable. Proteases of the subtilisin type are preferably used, proteases obtained from *Bacillus lentus* being particularly preferred. Of particular interest in this regard are enzyme mixtures, for example of protease and amylase or protease and lipase or lipolytic enzymes or protease and cellulase or of cellulase and lipase or lipolytic enzymes or of protease, amylase and lipase or lipolytic enzymes or protease, lipase or lipolytic enzymes and cellulase, but especially protease- and/or lipase-containing mixtures or mixtures with lipolytic enzymes. Examples of such lipolytic enzymes are the known cutinases. Peroxidases or oxidases have also been successfully used in some cases. Suitable amylases include in particular α-amylases, isoamylases, pullanases and pectinases. Preferred cellulases are cellobiohydrolases, endoglucanases and β-glucosidases, which are also known as cellobiases, and mixtures thereof. Since the various cellulase types differ in their CMCase and avicelase activities, the desired activities can be established by mixing the cellulases in the appropriate ratios. The enzymes may be adsorbed to supports and/or encapsulated in membrane materials to protect them against premature decomposition. The percentage content of enzymes, enzyme mixtures or enzyme granules may be, for example, about 0.1 to 5% by weight and is preferably from 0.1 to about 2% by weight.

In addition to the monohydric and polyhydric alcohols, the preparations may contain other enzyme stabilizers. For example, 0.5 to 1% by weight of sodium formate may be used. Proteases stabilized with soluble calcium salts and having a calcium content of preferably about 1.2% by weight, based on the enzyme, may also be used. Apart from calcium salts, magnesium salts also serve as stabilizers. However, it is of particular advantage to use boron compounds, for example boric acid, boron oxide, borax and other alkali metal borates, such as the salts of orthoboric acid ($H_3BO_3$), metaboric acid ($HBO_2$) and pyroboric acid (tetraboric acid $H_2B_4O_7$).

Redeposition Inhibitors

The function of redeposition inhibitors is to keep the soil detached from the fibers suspended in the wash liquor and thus to prevent the soil from being re-absorbed by the washing. Suitable redeposition inhibitors are water-soluble, generally organic colloids, for example the water-soluble salts of polymeric carboxylic acids, glue, gelatine, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example degraded starch, aldehyde starches, etc., may also be used. Polyvinyl pyrrolidone is also suitable. However, cellulose ethers, such as carboxymethyl cellulose (sodium salt), methyl cellulose, hydroxyalkyl cellulose, and mixed ethers, such as methyl hydroxyethyl cellulose, methyl hydroxypropyl cellulose, methyl carboxymethyl cellulose and mixtures thereof, and polyvinyl pyrrolidone are also preferably used, for example in quantities of 0.1 to 5% by weight, based on the preparation.

Optical Brighteners

The preparations may contain derivatives of diaminostilbene disulfonic acid or alkali metal salts thereof as optical brighteners. Suitable optical brighteners are, for example, salts of 4,4'-bis-(2-anilino-4-morpholino-1,3,5-triazinyl-6-amino)-stilbene-2,2'-disulfonic acid or compounds of similar structure which contain a diethanolamino group, a methylamino group and anilino group or a 2-methoxyethylamino group instead of the morpholino group. Brighteners of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)-4'-(2-sulfostyryl)-diphenyl, may also be present. Mixtures of the brighteners mentioned may also be used. Uniformly white granules are obtained if, in addition to the usual brighteners in the usual quantities, for example between 0.1 and 0.5% by weight and preferably between 0.1 and 0.3% by weight, the detergents/cleaning compositions also contain small quantities, for example $10^{-6}$ to $10^{-3}$% by weight and preferably around $10^{-5}$% by weight, of a blue dye. A particularly preferred dye is Tinolux® (a product of Ciba-Geigy).

Defoamers

Wax-like compounds may be used as defoamers in accordance with the present invention. "Wax-like" compounds are understood to be compounds which have a melting point at atmospheric pressure above 25° C. (room temperature), preferably above 50° C. and more preferably above 70° C. The wax-like defoamers are substantially insoluble in water, i.e. their solubility in 100 g of water at 20° C. is less than 0.1% by weight. In principle, any wax-like defoamers known from the prior art may additionally be present. Suitable wax-like compounds are, for example, bisamides, fatty alcohols, fatty acids, carboxylic acid esters of monohydric and polyhydric alcohols and paraffin waxes or mixtures thereof. Alternatively, the silicone compounds known for this purpose may of course also be used.

Suitable paraffin waxes are generally a complex mixture with no clearly defined melting point. For characterization, its melting range is normally determined by differential thermoanalysis (DTA), as described in "The Analyst" 87 (1962), 420, and/or its solidification point is determined. The solidification point is understood to be the temperature at which the paraffin changes from the liquid state into the solid state by slow cooling. Paraffins which are entirely liquid at room temperature, i.e. paraffins with a solidification point below 25° C., are not suitable for use in accordance with the invention. Soft waxes which have a melting point of 35 to 50° C. preferably include the group of petrolates and hydrogenation products thereof. They are composed of microcrystalline paraffins and up to 70% by weight of oil, have an ointment-like to plastic, firm consistency and represent bitumen-free residues from the processing of petroleum. Distillation residues (petrolatum stock) of certain paraffin-based and mixed-base crude oils further processed to Vaseline are particularly preferred. Bitumen-free oil-like to solid hydrocarbons separated from distillation residues of paraffin-based or mixed-base crude oil and cylinder oil distillates are also preferred. They are of semisolid, smooth, tacky to plastic and firm consistency and have melting points of 50 to 70° C. These petrolates are the most important starting materials for the production of microwaxes. The solid hydrocarbons with melting points of 63 to 79° C. separated from high-viscosity, paraffin-containing lubricating oil distillates during deparaffinization are also suitable. These petrolates are mixtures of microcrystalline waxes and high-melting n-paraffins. It is possible, for example, to use the paraffin wax mixtures known from EP 0309931 A1 of, for example, 26% by weight to 49% by weight of microcrystalline paraffin wax with a solidification point of 62° C. to 90° C., 20% by weight to 49% by weight of hard paraffin with a solidification point of 42° C. to 56° C. and 2% by weight to 25% by weight of soft paraffin with a solidification point of 35° C. to 40° C. Paraffins or paraffin mixtures which solidify at temperatures of 30° C. to 90° C. are preferably used. It is important in this connection to bear in mind that even paraffin wax mixtures which appear solid at room temperature may contain different amounts of liquid paraffin. In the paraffin waxes suitable for use in accordance with the invention, this liquid component is as small as possible and is preferably absent altogether. Thus, particularly preferred paraffin wax mixtures have a liquid component at 30° C. of less than 10% by weight and, more particularly, from 2% by weight to 5% by weight, a liquid component at 40° C. of less than 30% by weight, preferably from 5% by weight to 25% by weight and more preferably from 5% by weight to 15% by weight, a liquid component at 60° C. of 30% by weight to 60% by weight and preferably 40% by weight to 55% by weight, a liquid component at 80° C. of 80% by weight to 100% by weight and a liquid component at 90° C. of 100% by weight. In particularly preferred paraffin wax mixtures, the temperature at which a liquid component of 100% by weight of the paraffin wax is reached is still below 85° C. and, more particularly, between 75° C. and 82° C. The paraffin waxes may be petrolatum, microcrystalline waxes or hydrogenated or partly hydrogenated paraffin waxes.

Bisamides suitable as defoamers are those derived from saturated fatty acids containing 12 to 22 and preferably 14 to 18 carbon atoms and from alkylenediamines containing 2 to 7 carbon atoms. Suitable fatty acids are lauric acid, myristic acid, stearic acid, arachic acid and behenic acid and the mixtures thereof obtainable from natural fats or hydrogenated oils, such as tallow or hydrogenated palm oil. Suitable diamines are, for example, ethylenediamine, 1,3-propylenediamine, tetramethylenediamine, pentamethylenediamine, hexamethylenediamine, p-phenylenediamine and toluylenediamine. Preferred diamines are ethylenediamine and hexamethylenediamine. Particularly preferred bisamides are bis-myristoyl ethylenediamine, bis-palmitoyl ethylenediamine, bis-stearoyl ethylenediamine and mixtures thereof and the corresponding derivatives of hexamethylenediamine.

Suitable carboxylic acid esters as defoamers are derived from carboxylic acids containing 12 to 28 carbon atoms. The esters in question are, in particular, esters of behenic acid, stearic acid, hydroxystearic acid, oleic acid, palmitic acid, myristic acid and/or lauric acid. The alcohol moiety of the carboxylic acid ester contains a monohydric or polyhydric alcohol containing 1 to 28 carbon atoms in the hydrocarbon chain. Examples of suitable alcohols are behenyl alcohol, arachidyl alcohol, cocoalcohol, 12-hydroxystearyl alcohol, oleyl alcohol and lauryl alcohol and ethylene glycol, glycerol, polyvinylvinyl alcohol, sucrose, erythritol, pentaerythritol, sorbitan and/or sorbitol. Preferred esters are esters of methanol, ethylene glycol, glycerol and sorbitan, the acid moiety of the ester being selected in particular from behenic acid, stearic acid, oleic acid, palmitic acid or myristic acid. Suitable esters of polyhydric alcohols are, for example, xylitol monopalmitate, pentaerythritol monostearate, glycerol monostearate, ethylene glycol monostearate and sorbitan monostearate, sorbitan palmitate, sorbitan monolaurate, sorbitan dilaurate, sorbitan distearate, sorbitan dibehenate, sorbitan dioleate and mixed tallow alkyl sorbitan monoesters and diesters. Suitable glycerol esters are the mono-, di- or triesters of glycerol and the carboxylic acids mentioned, the monoesters and diesters being preferred. Glycerol monostearate, glycerol monooleate, glycerol monopalmitate, glycerol monobehenate and glycerol distearate are examples. Examples of suitable natural esters as defoamers are beeswax, which mainly consists of the esters $CH_3(CH_2)_{24}COO(CH_2)_{27}CH_3$ and $CH_3(CH_2)_{26}COO(CH_2)_{25}CH_3$, and carnauba wax, carnauba wax being a mixture of carnauba acid alkyl esters, often in combination with small amounts of free carnauba acid, other long-chain acids, high molecular weight alcohols and hydrocarbons.

Suitable carboxylic acids as another defoamer compound are, in particular, behenic acid, stearic acid, oleic acid, palmitic acid, myristic acid and lauric acid and the mixtures thereof obtainable from natural fats or optionally hydrogenated oils, such as tallow or hydrogenated palm oil. Saturated fatty acids containing 12 to 22 and, more particularly, 18 to 22 carbon atoms are preferred.

Dialkyl ethers may also be present as defoamers. The ethers may have an asymmetrical or symmetrical structure, i.e. they may contain two identical or different alkyl chains, preferably containing 8 to 18 carbon atoms. Typical examples are di-n-octyl ether, di-1-octyl ether and di-n-stearyl ether, dialkyl ethers with a melting point above 25° C. and more particularly above 40° C. being particularly suitable.

Other suitable defoamer compounds are fatty ketones which may be obtained by the relevant methods of preparative organic chemistry. They are produced, for example, from carboxylic acid magnesium salts which are pyrolyzed at temperatures above 300° C. with elimination of carbon dioxide and water, for example in accordance with DE 2553900 OS. Suitable fatty ketones are produced by pyrolysis of the magnesium salts of lauric acid, myristic acid, palmitic aid, palmitoleic acid, stearic acid, oleic acid, elaidic acid, petroselic acid, arachic acid, gadoleic acid, behenic acid or erucic acid.

Other suitable defoamers are fatty acid polyethylene glycol esters which are preferably obtained by the homogeneously base-catalyzed addition of ethylene oxide onto fatty acids. The addition of ethylene oxide onto the fatty acids takes place in particular in the presence of alkanolamines as catalysts. The use of alkanolamines, especially triethanolamine, leads to extremely selective ethoxylation of the fatty acids, particularly where it is desired to produce compounds with a low degree of ethoxylation. Within the group of fatty acid polyethylene glycol esters, those with a melting point above 25° C. and more particularly above 40° C. are preferred.

Within the group of wax-like defoamers, the described paraffin waxes—in a particularly preferred embodiment—are used either on their own as wax-like defoamers or in admixture with one of the other wax-like defoamers, the percentage content of the paraffin waxes in the mixture preferably exceeding 50% by weight, based on the wax-like defoamer mixture. If necessary, the paraffin waxes may be applied to supports. Suitable support materials in the context of the present invention are any known inorganic and/or organic support materials. Examples of typical inorganic support materials are alkali metal carbonates, alumosilicates, water-soluble layer silicates, alkali metal silicates, alkali metal sulfates, for example sodium sulfate, and alkali metal phosphates. The alkali metal silicates are preferably a compound with a molar ratio of alkali metal oxide to $SiO_2$ of 1:1.5 to 1:3.5. The use of silicates such as these results in particularly good particle properties, more particularly high abrasion resistance and at the same time a high dissolving rate in water. Alumosilicates as a support material include, in particular, the zeolites, for example zeolite NaA and NaX. The compounds described as water-soluble layer silicates include, for example, amorphous or crystalline waterglass. Silicates commercially available as Aerosil® or Sipernat® may also be used. Suitable organic carrier materials are, for example, film-forming polymers, for example polyvinyl alcohols, polyvinyl pyrrolidones, poly(meth)acrylates, polycarboxylates, cellulose derivatives and starch. Suitable cellulose ethers are, in particular, alkali metal carboxymethyl cellulose, methyl cellulose, ethyl cellulose, hydroxyethyl cellulose and so-called cellulose mixed ethers, for example methyl hydroxyethyl cellulose and methyl hydroxypropyl cellulose, and mixtures thereof. Particularly suitable mixtures are mixtures of sodium carboxymethyl cellulose and methyl cellulose, the carboxymethyl cellulose normally having a degree of substitution of 0.5 to 0.8 carboxymethyl groups per anhydroglucose unit while the methyl cellulose has a degree of substitution of 1.2 to 2 methyl groups per anhydroglucose unit. The mixtures preferably contain alkali metal carboxymethyl cellulose and nonionic cellulose ether in ratios by weight of 80:20 to 40:60 and, more particularly, 75:25 to 50:50. Another suitable support is native starch which is made up of amylose and amylopectin. Native starch is starch obtainable as an extract from natural sources, for example from rice, potatoes, corn and wheat. Native starch is a standard commercial product and is therefore readily available. Suitable support materials are individual compounds or several of the compounds mentioned above selected in particular from the group of alkali metal carbonates, alkali metal sulfates, alkali metal phosphates, zeolites, water-soluble layer silicates, alkali metal silicates, polycarboxylates, cellulose ethers, polyacrylate/polymethacrylate and starch. Mixtures of alkali metal carbonates, more particularly sodium carbonate, alkali metal silicates, more particularly sodium silicate, alkali metal sulfates, more particularly sodium sulfate, and zeolites are particularly suitable.

Suitable silicones in the context of the present invention are typical organopolysiloxanes containing fine-particle silica which, in turn, may even be silanized. Corresponding organopolysiloxanes are described, for example, in European patent application EP 0496510 A1. Polydiorganosiloxanes and, in particular, polydimethylsiloxanes known from the prior art are particularly preferred. Suitable polydiorganosiloxanes have a substantially linear chain and a degree of oligomerization of 40 to 1,500. Examples of suitable substituents are methyl, ethyl, propyl, isobutyl, tert. butyl and phenyl. Amino-, fatty-acid-, alcohol-, polyether-, epoxy-, fluorine-, glycoside- and/or alkyl-modified silicone compounds which may be both liquid and resin-like at room temperature are also suitable, as are simethicones, i.e. mixtures of dimethicones with an average chain length of 200 to 300 dimethyl siloxane units and hydrogenated silicates. Normally, the silicones in general and the polydiorganosiloxanes in particular contain fine-particle silica which may even be silanized. Silica-containing dimethyl polysiloxanes are particularly suitable for the purposes of the invention. The polydiorganosiloxanes advantageously have a Brookfield viscosity at 25° C. (spindle 1, 10 r.p.m.) of 5,000 mPas to 30,000 mPas and, more particularly, 15,000 mPas to 25,000 mPas. The silicones are preferably used in the form of aqueous emulsions. The silicone is generally added with stirring to water. If desired, thickeners known from the prior art may be added to the aqueous silicone emulsions to increase their viscosity. These known thickeners may be inorganic and/or organic materials, particularly preferred thickeners being nonionic cellulose ethers, such as methyl cellulose, ethyl cellulose and mixed ethers, such as methyl hydroxyethyl cellulose, methyl hydroxypropyl cellulose, methyl hydroxybutyl cellulose and anionic carboxycellulose types, such as carboxymethyl cellulose sodium salt (CMC). Particularly suitable thickeners are mixtures of CMC and nonionic cellulose ethers in a ratio by weight of 80:20 to 40:60 and more particularly 75:25 to 60:40. In general, concentrations of ca. 0.5 to 10 and more particularly 2.0 to 6% by weight—expressed as thickener mixture and based on aqueous silicone emulsion—are recommended, particularly where the described thickener mixtures are added. The content of silicones of the described type in the aqueous emulsions is advantageously in the range from 5 to 50% by weight and more particularly in the range from 20 to 40% by weight, expressed as silicone and based on aqueous emulsion. In another advantageous embodiment, the aqueous silicone solutions contain starch from natural sources, for example from rice, potatoes, corn and wheat, as thickener. The starch is advantageously present in quantities of 0.1 to 50% by weight, based on silicone emulsion, and more particularly in admixture with the already described thickeners of sodium carboxymethyl cellulose and a nonionic cellulose ether in the quantities already mentioned. The aqueous silicone emulsions are preferably prepared by preswelling the thickeners present, if any, before adding the silicones. The silicones are preferably incorporated using effective mixers and stirrers.

Disintegrators

The solid preparations may also contain disintegrators. Disintegrators are substances which are present in the shaped bodies to accelerate their disintegration on contact with water. Disintegrators are reviewed, for example, in J. Pharm. Sci. 61 (1972), in Römpp Chemielexikon, 9th Edition, Vol. 6, page 4440 and in Voigt "Lehrbuch der pharmazeutischen Technolgie" (6th Edition, 1987, pp. 182–184). These substances are capable of undergoing an increase in volume on contact with water so that, on the one hand, their own volume is increased (swelling) and, on the other hand, a pressure can be generated through the release of gases which causes the tablet to disintegrate into relatively small particles. Well-known disintegrators are, for example, carbonate/citric acid systems, although other organic acids may also be used. Swelling disintegration aids are, for example, synthetic polymers, such as polyvinyl pyrrolidone (PVP), or natural polymers and modified natural substances, such as cellulose and starch and derivatives thereof, alginates or casein derivatives. According to the invention, preferred disintegrators are cellulose-based disintegrators. Pure cellulose has the formal empirical composition $(C_6H_{10}O_5)_n$ and, formally, is a β-1,4-polyacetal of cellobiose which, in turn, is made up of two molecules of glucose. Suitable celluloses consist of ca. 500 to 5,000 glucose units and, accordingly, have average molecular weights of 50,000 to 500,000. According to the invention, cellulose derivatives obtainable from cellulose by polymer-analog reactions may also be used as cellulose-based disintegrators. These chemically modified celluloses include, for example, products of esterification or etherification reactions in which hydroxy hydrogen atoms have been substituted. However, celluloses in which the hydroxy groups have been replaced by functional groups that are not attached by an oxygen atom may also be used as cellulose derivatives. The group of cellulose derivatives includes, for example, alkali metal celluloses, carboxymethyl cellulose (CMC), cellulose esters and ethers and aminocelluloses. The cellulose derivatives mentioned are preferably not used on their own, but rather in the form of a mixture with cellulose as cellulose-based disintegrators. The content of cellulose derivatives in mixtures such as these is preferably below 50% by weight and more preferably below 20% by weight, based on the cellulose-based disintegrator. In one particularly preferred embodiment, pure cellulose free from cellulose derivatives is used as the cellulose-based disintegrator. Microcrystalline cellulose may be used as another cellulose-based disintegration aid or as part of such a component. This microcrystalline cellulose is obtained by partial hydrolysis of celluloses under conditions which only attack and completely dissolve the amorphous regions (ca. 30% of the total cellulose mass) of the celluloses, but leave the crystalline regions (ca. 70%) undamaged. Subsequent de-aggregation of the microfine celluloses formed by hydrolysis provides the microcrystalline celluloses which have primary particle sizes of ca. 5 μm and which can be compacted, for example, to granules with a mean particle size of 200 μm. Viewed macroscopically, the disintegrators may be homogeneously distributed in the shaped bodies although, when observed under a microscope, they form zones of increased concentration due to their production. Disintegrators which may be present in accordance with the invention such as, for example, collodion, alginic acid and alkali metal salts thereof, amorphous or even partly crystalline layer silicates (bentonites), polyacrylates, polyethylene glycols can be found, for example, in WO 98/40462 (Rettenmaier), WO 98/55583 and WO 98/55590 (Unilever) and WO 98/40463, DE 19709991 and DE 19710254 (Henkel). Reference is specifically made to the teaching of these documents. The shaped bodies may contain the disintegrators in quantities of 0.1 to 25% by weight, preferably 1 to 20% by weight and more particularly 5 to 15% by weight, based on the shaped bodies.

Perfumes

Suitable perfume oils or perfumes include individual perfume compounds, for example synthetic products of the ester, ether, aldehyde, ketone, alcohol and hydrocarbon type. Perfume compounds of the ester type are, for example, benzyl acetate, phenoxyethyl isobutyrate, p-tert.butyl cyclohexyl acetate, linalyl acetate, dimethyl benzyl carbinyl acetate, phenyl ethyl acetate, linalyl benzoate, benzyl formate, ethyl methyl phenyl glycinate, allyl cyclohexyl propionate, styrallyl propionate and benzyl salicylate. The ethers include, for example, benzyl ethyl ether; the aldehydes include, for example, the linear alkanals containing 8 to 18 carbon atoms, citral, citronellal, citronellyloxyacetaldehyde, cyclamen aldehyde, hydroxycitronellal, lilial and bourgeonal; the ketones include, for example, the ionones, α-isomethyl ionone and methyl cedryl ketone; the alcohols include anethol, citronellol, eugenol, geraniol, linalool, phenyl ethyl alcohol and terpineol and the hydrocarbons include, above all, the terpenes, such as limonene and pinene. However, mixtures of various perfumes which together produce an attractive perfume note are preferably used. Perfume oils such as these may also contain natural perfume mixtures obtainable from vegetable sources, for example pine, citrus, jasmine, patchouli, rose or ylang-ylang oil. Also suitable are clary oil, camomile oil, clove oil, melissa oil, mint oil, cinnamon leaf oil, lime blossom oil, juniper berry oil, vetiver oil, olibanum oil, galbanum oil and ladanum oil and orange blossom oil, neroli oil, orange peel oil and sandalwood oil.

The perfumes may be directly incorporated in the preparations according to the invention, although it can also be of advantage to apply the perfumes to supports which strengthen the adherence of the perfume to the washing and which provide the textiles with a long-lasting fragrance through a slower release of the perfume. Suitable support materials are, for example, cyclodextrins, the cyclodextrin/perfume complexes optionally being coated with other auxiliaries.

Inorganic Salts

Other suitable ingredients of the preparations are water-soluble inorganic salts, such as bicarbonates, carbonates, amorphous silicates, normal waterglasses with no pronounced builder properties or mixtures thereof. One particular embodiment is characterized by the use of alkali metal carbonate and/or amorphous alkali metal silicate, above all sodium silicate with a molar $Na_2O:SiO_2$ ratio of 1:1 to 1:4.5 and preferably 1:2 to 1:3.5. The sodium carbonate content of the final preparations is preferably up to 40% by weight and advantageously from 2 to 35% by weight. The content of sodium silicate (without particular building properties) in the preparations is generally up to 10% by weight and preferably between 1 and 8% by weight. In addition, sodium sulfate, for example, may be present as filler in quantities of 0 to 10% by weight and more particularly 1 to 5% by weight, based on the preparation.

The preparations according to the invention may have a residual moisture content from their production of at most 25% by weight, preferably at most 10% by weight, more preferably at most 8% by weight and most preferably below 5% by weight. This does not include the water content of the zeolites.

A preferred embodiment is characterized by the use of preparations containing 6 to 75% by weight, preferably 10 to 40% by weight of nonionic surfactants and 25 to 94% by weight, preferably 50 to 80% by weight of inorganic or organic carriers, with the proviso that the quantities mentioned add up to 100% by weight with the polymers, optionally other surfactants and auxiliaries/additives and optionally with water.

It has surprisingly been found that the solid preparations according to the invention of hydroxy mixed ethers in combination with polymers on carriers satisfy the required complex requirement profile entirely satisfactorily. In particular, these surfactants with inorganic or organic carriers can readily be processed to solids which do not gel but show the required delayed dissolving kinetics. Using the solid preparations, for example in the form of granules, it is possible to formulate in particular powders or even tablets with a clear rinse effect. In combination with cleaners or regenerating agents for the ion exchanger, so-called "3-in-1" systems can be produced. Besides their use in dishwashers, the solid preparations may also be used for the conventional cleaning of hard surfaces and for the production of laundry detergents. The invention includes the observation that the use of the preparations according to the invention not only results in good clear drying effects, it also gives the best results in regard both to foam suppression, particularly in the presence of proteins, and to temperature stability.

Production Process

The invention also relates to a process for the production of the solid preparations according to the invention as a starting compound for laundry detergents, dishwashing detergents and cleaning compositions, preferably dishwasher detergents, characterized in that hydroxy mixed ethers of formula (I) and polymers, optionally other surfactants and optionally other auxiliaries and additives are applied to inorganic or organic carriers.

Production may be carried out by thoroughly mixing hydroxy mixed ethers, polymers, optionally other surfactants and auxiliaries/additives with carriers.

In a preferred embodiment, only the surface of the carriers is coated with hydroxy mixed ethers, polymers, optionally other surfactants and auxiliaries/additives.

The preparations are preferably produced by mixing the hydroxy mixed ethers and polymers, optionally other surfactants and the carriers and optionally the other additives and agglomerating the resulting mixture.

In one preferred embodiment, the solid preparations may be produced by mixing the components in plowshare, L ödige or Eirich mixers.

In another preferred embodiment, they are produced by spray drying or by complex granulation processes, for example fluidized bed granulation, press agglomeration, extrusion, roll compacting, pelleting or tabletting.

In a particularly preferred embodiment, at least the hydroxy mixed ether component with the polymers is produced by fluidized bed granulation.

In another particularly preferred embodiment, water-containing preparations of the carrier, for example the alkali metal silicate or the alkali metal carbonate, are sprayed together with other components in a spray dryer, drying optionally being accompanied by granulation.

Spray Drying

The dryer into which the aqueous preparation is sprayed can be any type of dryer. In one preferred embodiment of the process, drying is carried out by spray drying in a drying tower. In this case, the aqueous preparations are exposed in known manner to a stream of drying gas in fine-particle form. Henkel KGaA describe an embodiment of spray drying using superheated steam in a number of published patents. The operating principle disclosed in those publications is hereby specifically included as part of the disclosure of the present invention. Reference is made in particular to the following publications: DE 4030688 A1 and the further developments according to DE 4204035 A1; DE 4204090 A1; DE 4206050 A1; DE 4206521 A1; DE 4206495 A1; DE 4208773 A1; DE 4209432 A1 and DE 4234376 A1. This process was introduced in connection with the production of the defoamer granules.

Fluidized Bed Granulation

A particularly preferred process for the production of the preparations comprises subjecting the starting materials to fluidized bed granulation ("SKET" granulation). SKET fluidized bed granulation is understood to be a simultaneous granulation and drying process preferably carried out in batches or continuously. The starting materials may be used both in dried form and in the form of a water-containing preparation. Preferred fluidized-bed arrangements have base plates measuring 0.4 to 5 m. The SKET granulation is preferably carried out at fluidizing air flow rates of 1 to 8 m/s. The granules are preferably discharged from the fluidized bed via a sizing stage. Sizing may be carried out, for example, by means of a sieve or by an air stream flowing in countercurrent (sizing air) which is controlled in such a way that only particles beyond a certain size are removed from the fluidized bed while smaller particles are retained in the fluidized bed. The inflowing air is normally made up of the heated or unheated sizing air and the heated bottom air. The temperature of the bottom air is between 80 and 400° C., preferably between 90 and 350° C. and more particularly below 70° C. A starting material, preferably surfactant granules from an earlier test batch, is advantageously introduced at the beginning of the granulation process.

Press Agglomeration

In another preferred variant, particularly where preparations of high bulk density are to be obtained, the mixtures are subsequently subjected to a compacting step, other ingredients being added to the preparations after this compacting step. In one preferred embodiment of the invention, the ingredients are compacted in a press agglomeration process. The press agglomeration process to which the solid premix (dried basic detergent) is subjected may be carried out in various agglomerators. Press agglomeration processes are classified according to the type of agglomerator used. The four most common press agglomeration processes—which are preferred to the purposes of the invention—are extrusion, roll compacting, pelleting and tabletting, so that preferred agglomeration processes for the purposes of the present invention are extrusion, roll compacting, pelleting and tabletting processes.

One feature common to all these processes is that the premix is compacted and plasticized under pressure and the individual particles are pressed against one another with a reduction in porosity and adhere to one another. In all the processes (but with certain limitations in the case of tabletting), the tools may be heated to relatively high temperatures or may be cooled to dissipate the heat generated by shear forces.

In all the processes, one or more binders may be used as (a) compacting auxiliary(ies). However, it must be made clear at this juncture that, basically, several different binders and mixtures of various binders may also be used. A preferred embodiment of the invention is characterized by the use of a binder which is completely in the form of a melt at temperatures of only at most 130° C., preferably at most 100° C. and more preferably up to 90° C. In other words, the binder will be selected according to the process and the process conditions or, alternatively, the process conditions and, in particular, the process temperature will have to be adapted to the binder if it is desired to use a particular binder.

The actual compacting process is preferably carried out at processing temperatures which, at least in the compacting step, at least correspond to the temperature of the softening point if not to the temperature of the melting point of the binder. In one preferred embodiment of the invention, the process temperature is significantly above the melting point or above the temperature at which the binder is present as a melt. In a particularly preferred embodiment, however, the process temperature in the compacting step is no more than 20° C. above the melting temperature or the upper limit to the melting range of the binder. Although, technically, it is quite possible to adjust even higher temperatures, it has been found that a temperature difference in relation to the melting temperature or to the softening temperature of the binder of 20° C. is generally quite sufficient and even higher temperatures do not afford additional advantages. Accordingly it is particularly preferred, above all on energy grounds, to carry out the compacting step above, but as close as possible to, the melting point or rather to the upper temperature limit of the melting range of the binder. Controlling the temperature in this way has the further advantage that even heat-sensitive raw materials, for example peroxy bleaching agents, such as perborate and/or percarbonate, and also enzymes, can be processed increasingly without serious losses of active substance. The possibility of carefully controlling the temperature of the binder, particularly in the crucial compacting step, i.e. between mixing/homogenizing of the premix and shaping, enables the process to be carried out very favorably in terms of energy consumption and with no damaging effects on the heat-sensitive constituents of the premix because the premix is only briefly exposed to the relatively high temperatures. In preferred press agglomeration processes, the working tools of the press agglomerator (the screw(s) of the extruder, the roller(s) of the roll compactor and the pressure roller(s) the pellet press) have a temperature of at most 150° C., preferably of at most 100° C. and, in a particularly preferred embodiment, at most 75° C., the process temperature being 30° C. and, in a particularly preferred embodiment, at most 20° C. above the melting temperature or rather the upper temperature limit to the melting range of the binder. The heat exposure time in the compression zone of the press agglomerators is preferably at most 2 minutes and, more preferably, between 30 seconds and 1 minute.

Preferred binders which may be used either individually or in the form of mixtures with other binders are polyethylene glycols, 1,2-polypropylene glycols and modified polyethylene glycols and polypropylene glycols. Combinations of polyethylene glycols with nonionic surfactants, particularly of the fatty alcohol polyglycol ether type, are particularly preferred. The modified polyalkylene glycols include, in particular, the sulfates and/or the disulfates of polyethylene glycols or polypropylene glycols with a relative molecular weight of 600 to 12,000 and, more particularly, in the range from 1,000 to 4,000. Another group consists of mono- and/or disuccinates of polyalkylene glycols which, in turn, have relative molecular weights of 600 to 6,000 and, preferably, in the range from 1,000 to 4,000. A more detailed description of the modified polyalkylene glycol ethers can be found in the disclosure of International patent application WO 93/02176. In the context of the present invention, polyethylene glycols include polymers which have been produced using $C_{3-5}$ glycols and also glycerol and mixtures thereof besides ethylene glycol as starting molecules. In addition, they also include ethoxylated derivatives, such as trimethylol propane containing 5 to 30 EO. The polyethylene glycols preferably used may have a linear or branched structure, linear polyethylene glycols being particularly preferred. Particularly preferred polyethylene glycols include those having relative molecular weights in the range from 2,000 to 12,000 and, advantageously, around 4,000. Polyethylene glycols with relative molecular weights below 3,500 and above 5,000 in particular may be used in combination with polyethylene glycols having a relative molecular weight of around 4,000. More than 50% by weight of such combinations may advantageously contain polyethylene glycols with a relative molecular weight of 3,500 to 5,000, based on the total quantity of polyethylene glycols. However, polyethylene glycols which, basically, are present as liquids at room temperature/1 bar pressure, above all polyethylene glycol with a relative molecular weight of 200, 400 and 600, may also be used as binders. However, these basically liquid polyethylene glycols should only be used in the form of a mixture with at least one other binder, this mixture again having to satisfy the requirements according to the invention, i.e. it must have a melting point or softening point at least above 45° C. Other suitable binders are low molecular weight polyvinyl pyrrolidones and derivatives thereof with relative molecular weights of up to at most 30,000. Relative molecular weight ranges of 3,000 to 30,000, for example around 10,000, are preferred. Polyvinyl pyrrolidones are preferably not used as sole binder, but in combination with other binders, more particularly in combination with polyethylene glycols.

Immediately after leaving the production unit, the compacted material preferably has temperatures of not more than 90° C., temperatures of 35 to 85° C. being particularly preferred. It has been found that exit temperatures—above all in the extrusion process—of 40 to 80° C., for example up to 70° C., are particularly advantageous.

Extrusion

In another preferred embodiment, the preparation according to the invention is produced by extrusion as described, for example, in European patent EP 0486592 B1 or International patent applications WO 93/02176 and WO 94/09111 or WO 98/12299. In this extrusion process, a solid premix is extruded under pressure to form a strand and, after emerging from the multiple-bore extrusion die, the strands are cut into granules of predetermined size by means of a cutting unit. The solid, homogeneous premix contains a plasticizer and/or lubricant of which the effect is to soften the premix under the pressure applied or under the effect of specific energy, so that it can be extruded. Preferred plasticizers and/or lubricants are surfactants and/or polymers. Particulars of the actual extrusion process can be found in the above-cited patents and patent applications to which reference is hereby expressly made. In one preferred embodiment of the invention, the premix is delivered, preferably continuously, to a planetary roll extruder or to a twin-screw extruder with co-rotating or contra-rotating screws, of which the barrel and the extrusion/granulation head can be heated to the predetermined extrusion temperature. Under the shear effect of the extruder screws, the premix is compacted under a pressure of preferably at least 25 bar or—with extremely high throughputs—even lower, depending on the apparatus used, plasticized, extruded in the form of fine strands through the multiple-bore extrusion die in the extruder head and, finally, size-reduced by means of a rotating cutting blade, preferably into substantially spherical or cylindrical granules. The bore diameter of the multiple-bore extrusion die and the length to which the strands are cut are adapted to the selected granule size. In this embodiment, granules are produced in a substantially uniformly predeterminable particle size, the absolute, particle sizes being adaptable to the particular application envisaged. In general, particle diameters of up to at most 0.8 cm are preferred. Important embodiments provide for the production of uniform granules in the millimeter range, for example in the range from 0.5 to 5 mm and more particularly in the range from about 0.8 to 3 mm. In one important embodiment, the length-to-diameter ratio of the primary granules is in the range from about 1:1 to about 3:1. In another preferred embodiment, the still plastic primary granules are subjected to another shaping process step in which edges present on the crude extrudate are rounded off so that, ultimately, spherical or substantially spherical extrudate granules can be obtained. If desired, small quantities of drying powder, for example zeolite powder, such as zeolite NaA powder, can be used in this step. This shaping step may be carried out in commercially available spheronizing machines. It is important in this regard to ensure that only small quantities of fines are formed in this stage. According to the present invention, drying—which is described as a preferred embodiment in the prior art documents cited above—may be carried out in a subsequent step but is not absolutely essential. It may even be preferred not to carry out drying after the compacting step. Alternatively, extrusion/compression steps may also be carried out in low-pressure extruders, in a Kahl press (manufacturer: Amandus Kahl) or in a so-called Bextruder (manufacturer: Bepex). In one particularly preferred embodiment of the invention, the temperature prevailing in the transition section of the screw, the pre-distributor and the extrusion die is controlled in such a way that the melting temperature of the binder or rather the upper limit to the melting range of the binder is at least reached and preferably exceeded. The temperature exposure time in the compression section of the extruder is preferably less than 2 minutes and, more particularly, between 30 seconds and 1 minute.

Roller Compacting

The solid preparations according to the invention may also be produced by roll compacting. In this variant, the premix is introduced between two rollers—either smooth or provided with depressions of defined shape—and rolled under pressure between the two rollers to form a sheet-like compactate. The rollers exert a high linear pressure on the premix and may be additionally heated or cooled as required. Where smooth rollers are used, smooth untextured compactate sheets are obtained. By contrast, where textured rollers are used, correspondingly textured compactates, in which for example certain shapes can be imposed in advance on the subsequent detergent particles, can be produced. The sheet-like compactate is then broken up into smaller pieces by a chopping and size-reducing process and can thus be processed to granules which can be further refined and, more particularly, converted into a substantially spherical shape by further surface treatment processes known per se. In roll compacting, too, the temperature of the pressing tools, i.e. the rollers, is preferably at most 150° C., more preferably at most 100° C. and most preferably at most 75° C. Particularly preferred production processes based on roll compacting are carried out at temperatures 10° C. and, in particular, at most 5° C. above the melting temperature of the binder or the upper temperature limit of the melting range of the binder. The temperature exposure time in the compression section of the rollers—either smooth or provided with depressions of defined shape—is preferably at most 2 minutes and, more particularly, between 30 seconds and 1 minute.

Pelleting

The preparations according to the invention may also be produced by pelleting. In this process, the premix is applied to a perforated surface and is forced through the perforations and at the same time plasticized by a pressure roller. In conventional pellet presses, the premix is compacted under pressure, plasticized, forced through a perforated surface in the form of fine strands by means of a rotating roller and, finally, is size-reduced to granules by a cutting unit. The pressure roller and the perforated die may assume many different forms. For example, flat perforated plates are used, as are concave or convex ring dies through which the material is pressed by one or more pressure rollers. In perforated-plate presses, the pressure rollers may also be conical in shape. In ring die presses, the dies and pressure rollers may rotate in the same direction or in opposite directions. A press suitable for carrying out the process according to the invention is described, for example, in DE 3816842 A1. The ring die press disclosed in this document consists of a rotating ring die permeated by pressure bores and at least one pressure roller operatively connected to the inner surface thereof which presses the material delivered to the die space through the pressure bores into a discharge unit. The ring die and pressure roller are designed to be driven in the same direction which reduces the shear load applied to the premix and hence the increase in temperature which it undergoes. However, the pelleting process may of course also be carried out with heatable or coolable rollers to enable the premix to be adjusted to a required temperature. In pelleting, too, the temperature of the pressing tools, i.e. the pressure rollers, is preferably at most 150° C., more preferably at most 100° C. and most preferably at most 75° C. Particularly preferred production processes based on pelleting are carried out at temperatures 10° C. and, in particular, at most 5° C. above the melting temperature of the binder or the upper temperature limit of the melting range of the binder.

Tabletting

The production of the solid preparations according to the invention as shaped bodies, preferably those in tablet form, is generally carried out by tabletting or press agglomeration. The particulate press agglomerates obtained may either be directly used as laundry/dishwashing detergent or cleaners or may be aftertreated beforehand by conventional methods. Conventional aftertreatments include, for example, powdering with fine-particle detergent ingredients which, in general, produces a further increase in bulk density. However, another preferred aftertreatment is the procedure according to German patent applications DE 19524287 A1 and DE 19547457 A1, according to which dust-like or at least fine-particle ingredients (so-called fine components) are bonded to the particulate end products produced in accordance with the invention which serve as core. This results in the formation of detergents which contain these so-called fine components as an outer shell. Advantageously, this is again done by melt agglomeration. On the subject of the melt agglomeration of fine components, reference is specifically made to the disclosure of German patent applications DE-A-19524287 and DE-A-19547457. In the preferred embodiment of the invention, the solid detergents are present in tablet form, the tablets preferably having rounded corners and edges, above all in the interests of safer storage and transportation. The base of the tablets may be, for example, circular or rectangular in shape. Multilayer tablets, particularly tablets containing two or three layers which may even have different colors, are particularly preferred. Blue-white or green-white or blue-green-white tablets are particularly preferred. The tablets may also have compressed and non-compressed parts. Tablets with a particularly advantageous dissolving rate are obtained if, before compression, the granular constituents contain less than 20% by weight and preferably less than 10% by weight of particles outside the 0.02 to 6 mm diameter range. A particle size distribution of 0.05 to 2.0 mm is preferred, a particle size distribution of 0.2 to 1.0 mm being particularly preferred.

In one particularly preferred embodiment, aqueous Na silicate solution, aqueous polymer solution or wax melts and mixtures thereof is/are sprayed onto the granules produced and the water is subsequently removed by drying, the granules thus being provided with a coating. Both silicate, wax and polymer solution count as carriers material in this embodiment.

Commercial Applications

The present invention also relates to the use of the solid preparations as a starting compound for the production of laundry detergents, dishwashing detergents and cleaning compositions, preferably dishwasher detergents, characterized in that the solid preparations are present in quantities of 2 to 80, preferably 7 to 60 and more particularly 20 to 50% by weight, based on the final preparations.

EXAMPLES

1. In a Lödige mixer, 60 g of 5% amphopolymer were introduced onto 800 g of Wessalith P at 2,000 r.p.m./room temperature, followed by mixing for 1 minute. 140 g of HME (Dehypon® KE 3557, Cognis) with a temperature of 50° C. (elevated temperature above the melting point of the HME) were then added over a period of 1 minute at the same rotational speed, followed by mixing for another minute. Free-flowing granules were obtained.

2. In a Lödige mixer, 60 g of 5% amphopolymer were introduced onto 800 g of STPP at 2,000 r.p.m./room temperature, followed by mixing for 1 minute. 140 g of HME (Dehypon® KE 3557, Cognis) with a temperature of 50° C. were then added over a period of 1 minute at the same rotational speed, followed by mixing for another minute. Free-flowing granules were obtained.

3. In a Lödige mixer, 60 g of 5% amphopolymer were introduced onto 740 g of STPP at 2,000 r.p.m./room temperature, followed by mixing for 1 minute. 100 g of Glucopon® 600 CSUP (APG 12/14) were then added at 200 r.p.m., followed by mixing for another minute. The granules obtained were dried in a fluidized bed at an inflowing air temperature of 140° C. The granules obtained had a residual moisture content of 0.9%. 140 g of HME (Dehypon® KE 3557, Cognis) with a temperature of 50° C. were then added to the granules in a Lödige mixer over a period of 1 minute at 2,000 r.p.m., followed by mixing for another minute. Free-flowing granules were obtained.

4. In a Lödige mixer, 300 g of 5% amphopolymer were introduced onto 710 g of STPP at 2,000 r.p.m./room temperature, followed by mixing for 1 minute. The granules obtained were dried in a fluidized bed at an inflowing air temperature of 140° C. The granules obtained had a residual moisture content of 0.8%. 270 g of HME (Dehypon® KE 3557, Cognis) with a temperature of 50° C. were then added to the granules in a Lödige mixer over a period of 1 minute at 2,000 r.p.m., followed by mixing for another minute. Free-flowing granules were obtained.

5. In a Lödige mixer, 300 g of 5% polyisopropyl acylamide were introduced onto 710 g of STPP at 2,000 r.p.m./room temperature, followed by mixing for 1 minute. The granules obtained were dried in a fluidized bed at an inflowing air temperature of 140° C. The granules obtained had a residual moisture content of 0.8%. 270 g of HME (Dehypon® KE 3557, Cognis) with a temperature of 50° C. were then added to the granules in a Lödige mixer over a period of 1 minute at 2,000 r.p.m., followed by mixing for another minute. Free-flowing granules were obtained.

COMPARISON EXAMPLE

In a Lödige mixer, 270 g of HME (Dehypon® KE 3557®, Cognis) with a temperature of 50° C. were introduced onto 730 g of STPP at 2,000 r.p.m./room temperature, followed by mixing for 1 minute. Free-flowing granules were obtained.

HME: hydroxy mixed ether, APG: alkyl polyglucoside, FAS: fatty alcohol sulfate, STTP: sodium tripolyphosphate.

Exemplary formulations of dishwasher detergents are shown in Table 1 below. Formulations I and II contain the solid preparations according to the invention in the form of a starting compound and other formulation ingredients. V1 is a comparison formulation which contains the same amounts of hydroxy mixed ether and polymer. However, they were not pre-formulated as solid preparations.

Various dishwasher powders were prepared in a mixer. In a Miele G661 SC dishwasher, quantities of 25 g of the powders were tested for their clear drying effect in the presence of soils and evaluated on a scale of (1)=very good to (5)=unsatisfactory. The results are set out in Table 1.

TABLE 1

Clear drying effect (quantities in %)

| Composition/performance | I | II | C1 |
|---|---|---|---|
| HME[1)] | — | — | 11.9 |
| Polymer | | | 0.66 |
| Granules of Example 4 (HME/polymer) | 44 (11.9/0.66) | 30 (8.1/0.45) | — (11.9/0.66) |
| $C_{12/14}$ fatty alcohol + 10EO butylether | 2 | 2 | 2 |
| Soda | 10 | 10 | 10 |
| Waterglass | 9 | 10 | 10 |
| Sodium tripolyphosphate | 14 | 24 | 45 |
| Sodium perborate hydrate | 10 | 10 | 10 |
| Sodium sulfate | — | — | 4 |
| Enzymes | 3 | 3 | 3 |
| Water | | to 100 | |
| Clear drying effect | 1 | 2 | 2 |

[1)] $C_{8/10}$ fatty alcohol + 1PO + 22EO-2-hydroxydecylether

The content of hydroxy mixed ethers (HME) and polymer was 11.9 g HME and 0.66 g polymer in Example I and Comparison Example C1, but only 8.1 g HME and 0.45 g polymer in Example II. It can be seen that the same clear drying effect is obtained using the solid preparations according to the invention, even with a smaller content of nonionic surfactant and polymer, whereas formulation I containing the solid preparation according to the invention (44%) proved to be superior for the same content by weight of HME and polymer.

What is claimed is:

1. A solid composition comprising (a) a hydroxy mixed ether of the formula (I):

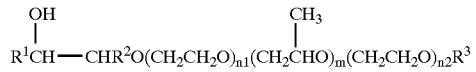

(I)

wherein $R^1$ is a linear or branched alkyl group having from 2 to 18 carbon atoms, $R^2$ is hydrogen or a linear or branched alkyl group having from 2 to 18 carbon atoms, $R^3$ is a linear or branched alkyl and/or alkenyl group having from 1 to 22 carbon atoms, each of n1 and n2 independently is a number from 0 to 60 and m is 0 or a number from 0.5 to 5, with the provisos that the total number of carbon atoms in the substituents $R^1$ and $R^2$ is at east 6 and the sum (n1+m+n2) is greater than 0: (b) a polymer comprising units constituted from monomer units of the formula

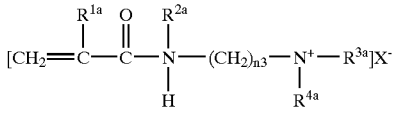

(Ia)

wherein n3 is a number from 2 to 4, $R^{1a}$ is hydrogen or a methyl group and each of $R^{2a}$, $R^{3a}$ and $R^{4a}$ is independently hydrogen or a $C_{1-4}$ alkyl or alkenyl group, $X^-$ is a halide anion or monoalkyl anion of sulfuric acid semiester; (c) optionally, a nonionic surfactant; (d) optionally, an inorganic or organic carrier; and (e) optionally, an auxiliary.

2. The composition of claim 1 wherein $R^1$ is a linear alkyl group having from 8 to 10 carbon atoms, $R^2$ is hydrogen, $R^3$ is a linear alkyl group having from 8 to 10 carbon atoms, n1 is 0, m is a number of 0.5 to 2 and n2 is a number of 20 to 40.

3. The composition of claim 1 wherein $R^1$ is a linear alkyl group having from 8 to 10 carbon atoms, $R^2$ is hydrogen, $R^3$ is a branched alkyl group having from 8 to 10 carbon atoms, each of n1 and m is 0 and n2 is a number from 20 to 40.

4. The composition of claim 1 wherein $R^1$ is a linear alkyl group having from 8 to 10 carbon atoms, $R^2$ is hydrogen, $R^3$ is a linear alkyl group having from 8 to 10 carbon atoms, each of n1 and m is 0 and n2 is a number from 40 to 60.

5. The composition of claim 1 wherein component (b) comprises at least one member selected from the group consisting of a polymer or copolymer of trialkylammonium alkyl (meth)acrylate, acrylamide, a dialkyldiallyl diammonium salt, a polymer analog reaction product of an ether or an ester of a polysaccharide containing ammonium side group, guar, cellulose and a starch derivative, a polyadduct of ethylene oxide with ammonium groups, polyesters and polyamides having quaternary side groups.

6. The composition of claim 1 wherein the ratio of (a) to (b) is from about 0.1:1 to about 1,000:1.

7. The composition of claim 6 wherein the ratio of (a) to (b) is from about 1:1 to about 100:1.

8. The composition of claim 6 wherein the ratio of (a) to (b) is from about 5:1 to about 50:1.

9. The composition of claim 1 wherein having a residual moisture content equal to or less than 25% by weight.

10. The composition of claim 9 wherein the residual moisture content is equal to or less than 10% by weight.

11. The composition of claim 1 wherein the nonionic surfactant comprises a member selected from the group consisting of fatty alcohol polylgycol ethers of the formula (II):

$$R^4O(CH_2CHR^5O)_{p1}H \quad \text{(II)}$$

wherein $R^4$ is a linear or branched alkyl and/or alkenyl group having from 6 to 22, $R^5$ is hydrogen or methyl and p1 is a number from 1 to 20; alkoxylated fatty acid lower alkyl esters of the formula (III):

$$R^6CO—(OCH_2CHR^7)_{p2}OR^8 \quad \text{(III)}$$

wherein $R^6CO$ is a linear or branched, saturated and/or unsaturated acyl group having from 6 to 22 carbon atoms, $R^7$ is hydrogen or methyl, $R^8$ is a linear or branched alkyl group having from 1 to 4 carbon atoms and p2 is a number from 1 to 20; alkyl or alkenyl oligoglycosides of the formula (IV):

$$R^9O\text{-}[G]_q \quad \text{(IV)}$$

wherein $R^9$ is an alkyl and/or alkenyl group having from 4 to 22 carbon atoms, G is a sugar unit having from 5 or 6 carbon atoms and p is a number from 1 to 10; mixed ethers of the formula (V)

$$R^{10}O(CH_2CH_2O)_{r1}(CH(CH_3)CH_2O)_s(CH_2CH_2O)_{r2}R^{11} \quad (V)$$

wherein $R^{10}$ is a linear or branched alkyl and/or alkenyl group having from 6 to 22 carbon atoms, $R^{11}$ is an alkyl group having from 1 to 8 carbon atoms or a benzyl group, each of r1 and r2 is independently a number from 0 to 20, s is 0 or a number from about 0.5 to about 5, with the proviso that the sum (r1+r2+s) is greater than 0 and mixtures thereof.

12. The composition of claim 1 wherein the total amount of all nonionic surfactants is from 6 to 75% by weight and the total amount of inorganic or organic carriers is from 25 to 94% by weight.

13. The composition of claim 1 wherein the total amount of all nonionic surfactants is from 10 to 40% by weight and the total amount of inorganic or organic carriers is from 50 to 80% by weight.

14. A solid composition comprising (a) a hydroxy mixed ether of the formula (I)

$$R^1\overset{OH}{\overset{|}{C}}H-CHR^2O(CH_2CH_2O)_{n1}(CH_2\overset{CH_3}{\overset{|}{C}}HO)_m(CH_2CH_2O)_{n2}R^3 \quad (I)$$

wherein $R^1$ is a linear or branched alkyl group having from 2 to 18 carbon atoms, $R^2$ is hydrogen or a linear or branched alkyl group having from 2 to 18 carbon atoms, $R^3$ is a linear or branched alkyl and/or alkenyl group having from 1 to 22 carbon atoms, each of n1 and n2 independently is a number from 0 to 60 and m is 0 or a number from 0.5 to 5, with the provisos that the total number of carbon atoms in the substituents $R^1$ and $R^2$ is at least 6 and the sum (n1+m+n2) is greater than 0; (b) a polymer comprising units constituted from monomer units of the formula $$[CH_2{=}\overset{R^{1a}}{\overset{|}{C}}-\overset{O}{\overset{\|}{C}}-\overset{R^{2a}}{\overset{|}{\underset{H}{\underset{|}{N}}}}-(CH_2)_{n3}-\overset{R^{4a}}{\overset{|}{N^+}}-R^{3a}]X^- \quad (Ia)$$

wherein n3 is a number from 2 to 4, $R^{1a}$ is hydrogen or a methyl group and each of $R^{2a}$, $R^{3a}$ and $R^{4a}$ is independently hydrogen or a $C_{1-4}$ alkyl or alkenyl group, $X^-$ is a halide anion or a monoalkyl anion of sulfuric acid semiester; (c) an auxiliary comprising at least one member selected from the group consisting of an anionic cosurfactant, a cobuilder, an oil- and fat-dissolving substance, a bleaching agent, a bleach activator, redeposition inhibitors, enzymes, enzyme stabilizers, optical brighteners, defoamers, disintegrators, perfumes, inorganic salts and (d) a carrier comprising at least one member selected from the group consisting of a zeolite, an alkali metal sulfate, an alkali metal phosphate, an alkali metal carbonate, an alkali metal hydrogen carbonate, an alkali metal silicate, an alkali metal citrate, a cellulose, a carboxymethyl cellulose, a cyclodextrin, a starch, a starch degradation product and a polyacrylate.

15. The composition of claim 14 wherein the weight ratio of (a+b+c)/(d) is from about of 1:1 to about 1:40.

16. A process for the production of the composition of claim 1 comprising mixing together a hydroxy mixed ether, a carrier and a polymer, and optionally an additional nonionic surfactant and optionally an auxiliary.

17. A process for the production of the composition of claim 1 comprising coating the surface of a carrier with a hydroxy mixed ether, a polymer, and optionally an additional nonionic surfactant and optionally an auxiliary.

* * * * *